US005714292A

United States Patent [19]

Anno et al.

[11] Patent Number: 5,714,292

[45] Date of Patent: Feb. 3, 1998

[54] TONER COMPRISING CALIX ARENE COMPOUND

[75] Inventors: Masahiro Anno, Sakai; Makoto Kobayashi, Settsu, both of Japan

[73] Assignee: Minolta Co., Ltd., Osaka, Japan

[21] Appl. No.: 576,839

[22] Filed: Dec. 21, 1995

Related U.S. Application Data

[63] Continuation of Ser. No. 295,053, Aug. 26, 1994, abandoned.

[30] Foreign Application Priority Data

Aug. 27, 1993 [JP] Japan ..... 5-212657
Sep. 20, 1993 [JP] Japan ..... 5-233116

[51] Int. Cl.[6] ..... J03G 9/087

[52] U.S. Cl. ..... 430/110; 430/106.6

[58] Field of Search ..... 430/110, 106.6, 430/108

[56] References Cited

U.S. PATENT DOCUMENTS

| | | | |
|---|---|---|---|
| 4,939,060 | 7/1990 | Tomiyama et al. | 430/109 |
| 5,049,467 | 9/1991 | Yamanaka . | |
| 5,318,883 | 6/1994 | Yamanaka et al. | 430/110 |

FOREIGN PATENT DOCUMENTS

| | | | |
|---|---|---|---|
| 0 385 580 | 9/1990 | European Pat. Off. . | |
| 0 514 867 | 11/1992 | European Pat. Off. . | |
| 514867 | 11/1992 | European Pat. Off. | 430/110 |
| 63-250662 | 10/1988 | Japan | 430/110 |
| 5-119534 | 5/1993 | Japan | 430/110 |
| 5119534 | 5/1993 | Japan . | |
| 5119536 | 5/1993 | Japan . | |

*Primary Examiner*—Christopher D. Rodee
*Attorney, Agent, or Firm*—McDermott, Will & Emery

[57] ABSTRACT

The present invention relates to a toner for developing an electrostatic latent image, comprising a calix arene compound expressed by the following general formula [I]:

[I]

wherein $R_1$ and $R_2$ each represent a hydrogen atom, an alkyl group having a carbon number of 1 to 5, or $-(CH_2)mCOOR_3$ (in which $R_3$ represents a hydrogen atom or a lower alkyl group; and m represents an integer of 1 to 3); n represents an integer of 0 to 7.

The present invention further relates to a charge-giving member comprising a calix arene compound expressed by the foregoing general formula [I].

35 Claims, 5 Drawing Sheets a: rotating direction of magnetic roll b: moving direction of developer

TONER COMPRISING CALIX ARENE COMPOUND

This is a continuation of application Ser. No. 08/295,053 filed Aug. 26, 1994 now abandoned.

BACKGROUND OF THE INVENTION

1. Field of the Invention

The present invention relates to a new toner for developing electrostatic latent images in electro-photography, electrostatic recording and electrostatic printing, and to a charge-giving member contributive to charge-giving to the toner in an image-forming process.

2. Description of the Prior Art

The development of an electrostatic latent image is carried out by causing a negatively or positively triboelectrically charged toner to be electrostatically adsorbed onto an electrostatic latent image formed on a photosensitive member. Then, the toner image is transferred onto a transfer paper and fixed.

Such a toner for developing a latent image is first of all required to have a reasonable amount of charge in order to provide a clear copy image which is free of fogs or the like. Further, it is required that the toner be not liable to change with time in its charge level, nor be it subject to such changes as noticeable charge decrease and solidification, due to environmental changes including, for example, temperature changes. As the charge decreases from the initial set value to an unreasonably low level, toner-scattering will increase, resulting in troubles, such as ground fogging, toner-scattering to white paper ground, and toner stains in a developing unit and associated surfaces.

In order to meet the foregoing requirements, a charge controlling agent is usually added during the process of toner making. Recently, with the advance of color copy, the development of white or light yellow charge controlling agents having good color reproducibility has been required.

At present, negative charge controlling agents, in colorless, white and light yellow, which impart a negative charge, are commercially available, but almost all of these agents are compounds containing a metal element, more particularly a heavy metal, for example, chromium-containing complexes or salts. Therefore, from the standpoint of safety, metal-free negative charge controlling agents which contain no heavy metal have been desired.

Whilst, recently there has been a demand for size reduction with respect to a developing machine in order to encourage the size reduction, price reduction and/or multicolor in copying machines. Further, from the standpoint of maintenance-free requirements, a unit of the developing machine is demanded. Because of these needs, a so-called single-component developing system has been paid attention to, which system is such that a thin toner layer is formed on a developing sleeve and the layer is brought into contact with a photosensitive member for development. However, unlike a two-component system in which a toner and a carrier are mixed in agitation for charging, the single-component system has a problem such that the time for toner charging is limited to a momentary time period in which the toner passes through the space between a layer-thickness levelling blade and the sleeve. As such, it is difficult to achieve any sufficient and uniform toner charging.

In view of this difficulty, it has been proposed to enhance charge giving to the toner by means of a transferring member, levelling member and/or friction member, for example, sleeve, doctor-blade, and carrier, which come into contact with the toner during the developing process, rather than attempting to achieve improvement in the toner-charging characteristics only through additives. However, above enumerated members are not only required to have high charging capability but also they must have high frictional resistance relative to the toner and good durability. For example, the carrier is required to be serviceable for a long time without replacement, and the sleeve is required to have the same degree of durability as the developing apparatus. In order to meet these requirements, attempts have been made to improve the charging characteristics of the toner by adding a specific charge controlling agent to the carrier, sleeve, doctor blade, etc.

In the present invention, members, such as transferring member, regulating member and friction element, are collectively referred to as "charge-giving member" to mean any and all materials and/or members which come in contact with a toner in a developing stage or prior to that stage to impart necessary electrical charges for development to the toner or supplementarily impart electrical charges to the toner.

SUMMARY OF THE INVENTION

Figure 1:
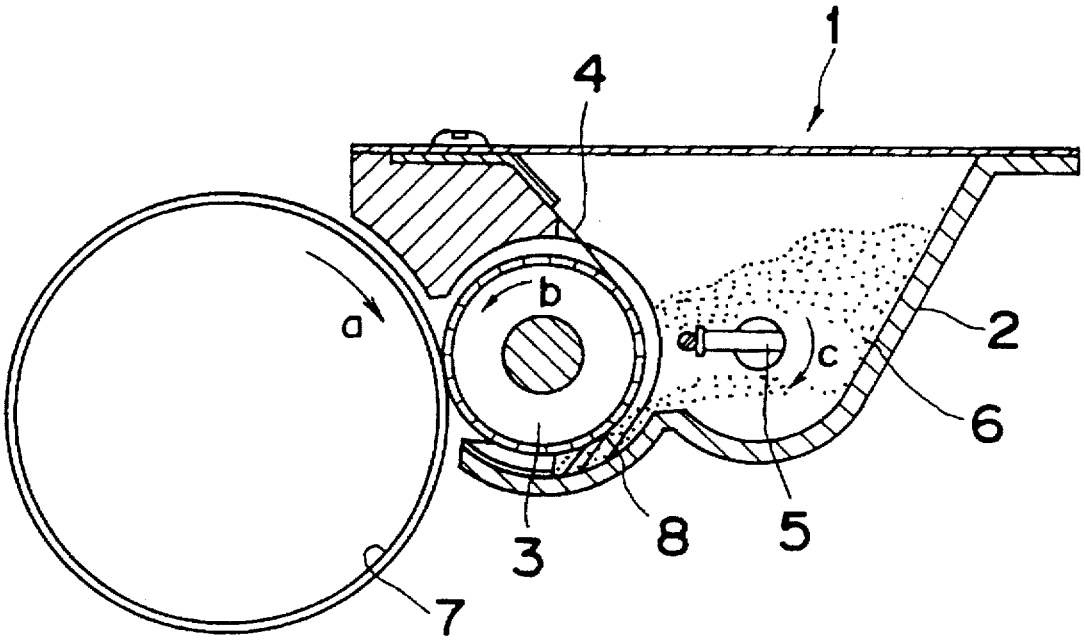
FIG. 1 shows a schematic arrangement of a developing apparatus.

An object of the invention is to provide a toner for developing an electrostatic latent image, comprising a negative charge controlling agent containing no heavy metal.

It is a second object of the present invention to provide a toner for developing an electrostatic latent image, which is excellent in electrification-build-up characteristics, high charging-stability, resistance to toner-spending phenomenon and environmental stability.

It is a third object of the present invention to provide a toner for developing an electrostatic latent image, which is excellent in color reproducibility and light-transmittance.

It is a fourth object of the present invention to provide a charge-giving member which imparts an adequate electrical charge to a toner for developing an electrostatic latent image.

It is a fifth object of the present invention to provide a charge-giving member which does not deteriorate even after it is used for a long time.

It is a sixth object of the present invention to provide a charge-giving member which can contribute toward image formation with good fine-line and tone reproducibility.

The present invention provides a toner for developing an electrostatic latent image, comprising a calix arene compound expressed by the following general formula [I]:

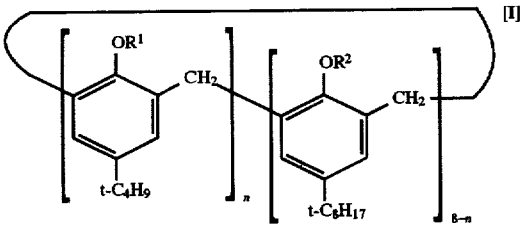

[I]

wherein $R_1$ and $R_2$ each represent a hydrogen atom, an alkyl group having a carbon number of 1 to 5, or —$(CH_2)mCOOR_3$ (in which $R_3$ represents a hydrogen atom or a lower alkyl group; and m represents an integer of 1 to 3); n represents an integer of 0 to 7.

The present invention further provides a charge-giving member comprising a calix arene compound expressed by the foregoing general formula [I].

DETAILED DESCRIPTION OF THE INVENTION

According to one aspect of the invention, there is provided a toner for developing an electrostatic latent image, comprising a calix arene compound expressed by the following general formula [I]:

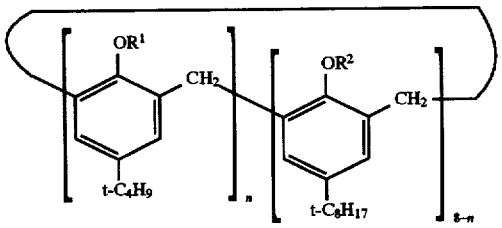

[I]

wherein $R_1$ and $R_2$ each represent a hydrogen atom, an alkyl group having a carbon number of 1 to 5, or —$(CH_2)mCOOR_3$ (in which $R_3$ represents a hydrogen atom or a lower alkyl group; and m represents an integer of 1 to 3); n represents an integer of 0 to 7.

According to another aspect of the invention, there is provided a charge-giving member comprising a calix arene compound expressed by the foregoing general formula [I].

In the general formula [I], $R_1$ and $R_2$ each represent a hydrogen atom, an alkyl group having a carbon number of 1 to 5, or —$(CH_2)mCOOR_3$ in which $R_3$ represents a hydrogen atom or a lower alkyl group (preferably, methyl, ethyl), m represents an integer of 1 to 3, preferably 1 and n represents an integer of 0 to 7.

In the foregoing formula [I], with respect to the t-octyl group-bonded aryl group and the t-butyl group-bonded aryl group, there is no particular limitation as to the order of the aryl groups.

Such calix arene compound is useful as a charge controlling agent for a toner and, more particularly, useful as a negative charge-controlling agent.

Such calix arene compound is also useful as a charge-giving material for a charge-giving member.

For the calix arene compound expressed as the general formula [1], the following may be exemplified;

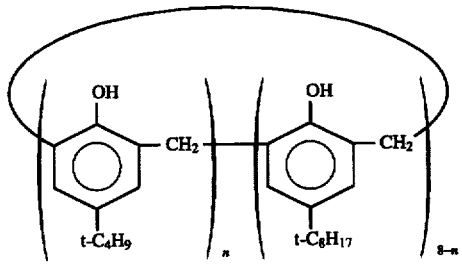

(n = 1~7)

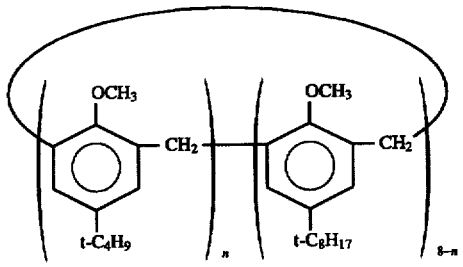

(n = 1~7)

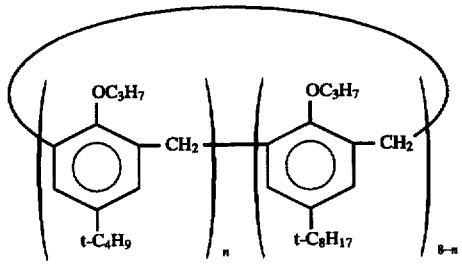

(n = 1~7)

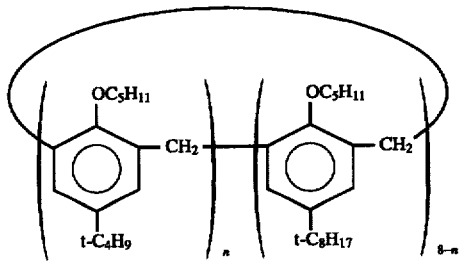

(n = 1~7)

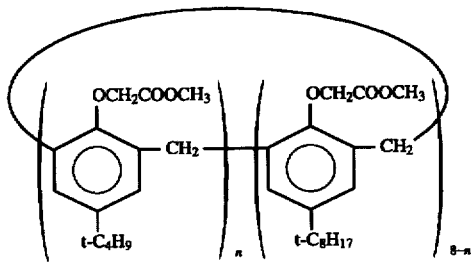

(n = 1~7)

The calix arene compound may be used in the form of a mixture of the above five compounds. As an alternative, one compound alone may be used. When one compound is used alone, a compound having a specific n value may be used alone or compounds having different n values may be used in mixture. In this case, the compounds in which n is 0 or n is 8 may be included.

The calix arene compound of the present invention may be easily synthesized according to the teachings of such publications as J. Am. Chem. Soc. 103 3782–3792 (1981); Pure & Appl. Chem. Vol. 58, No. 11, 1523–1528 (1985); Tetrahedron Letters, Vol. 26, No. 28, 3343–3344 (1985); and Gendai Kagaku, 182 14–23 (1986). The calix arene compound of the invention can be synthesized, for example, from phenol and formaldehyde at a high yield, especially where thick alkali is used.

The calix arene compound expressed by the general formula [I] may be applicable to various known toners including, for example: a toner of a pulverizing process type which is produced by subjecting a binder resin, a colorant and, as required, other ingredients, to the steps of heating and melting, and cooling, followed by pulverizing and classifying; a toner of a suspension polymerization type which is produced by dispersing in water more than one kind of monomers and a polymerization initiator substantially insoluble in water but soluble in the monomer to cause a reaction for polymerization; a toner of an encapsulated type which comprises a core containing a binder resin and a colorant, and an outer layer covering the core; a toner of a suspension granulated type which is produced by dispersing in a dispersion medium a resin solution composed of an organic solvent and a binder resin dissolved therein; a toner of a non-aqueous dispersion polymerization type which is obtained by dispersing more than one kind of monomers and a polymerization initiator substantially insoluble in water but soluble in the monomer in a dispersion medium composed of an organic solvent or a water/organic solvent mixture to cause a reaction for polymerization; a toner composed of a thermoplastic resin matrix and a dispersion phase of a thermoplastic resin dispersed in the matrix but separated in phase from the matrix, with substantially all of the colorant being contained in the dispersion phase; a toner produced by heating and agglomerating particles composed at least of a resin and a colorant which are obtained by suspension polymerization, and then pulverizing the resulting agglomerates; a toner obtained by a spray drying process; a spherical toner obtained by heat-treating the pulverizing process toner, and a toner of the type in which spherical particles and irregularly configured particles are present in mixture. The calix arene compound may be contained in the interior of any type of toner or may be fixedly attached to surface of the toner.

For the purpose of interior loading, the calix arene compound, as a charge controlling agent, is added in conjunction with additives, such as colorant; and the ingredients may be processed into the desired type of toner, e.g., grinding type toner, suspension polymerization toner, or encapsulated toner, according to the relevant conventional method. In the case of encapsulated toner, it is desirable to arrange that the charge controlling agent is contained in the outer layer.

In order to attach the charge controlling agent to the surface of the outer layer, the agent may be adhered to the surface of the toner by utilizing van der Waals forces and electrostatic forces, and then fixed by mechanical impact or the like. This process may be carried out either by a wet method or a dry method.

Dry process apparatuses which can be advantageously employed in such a method include "Hybridization System" (made by Nara Kikai Seisakusho K.K.), "Angmill" (made by Hosokawa Mikuron K.K.), and "Mechanomill" (made by Okada Seikosha K.K.), which apparatuses utilize a so-called high speed air stream impact technique. It is understood, however, that the above apparatuses are merely given by way of example and not for limitation.

A content of the calix arene compound expressed by the general formula [I] should be suitably selected depending on the conditions involved, such as type of toner, toner additive, type of matrix resin, and toner development system (two component or single-component). Where the compound is to be contained in the interior of the toner by a pulverizing or suspension method, a content is 0.1–20 parts by weight, preferably 1–10 parts by weight, more preferably 1–5 parts by weight, relative to 100 parts by weight of the resin for toner. If the content is less than 0.1 part by weight, a desired charging level cannot be obtained. If the content is greater than 20 parts by weight, toner can not be electrically charged stably and fixing properties are deteriorated.

Where the calix arene compound is to be fixedly adhered to the surface of toner, its content is 0.001–10 parts by weight, preferably 0.05–2 parts by weight, more preferably 0.1–1 part by weight, relative to 100 parts by weight of toner particles. If the content is less than 0.001 part by weight, the amount of the charge controlling agent present on the surface of toner particles is excessively small so that the charge amount is insufficient. If the content is greater than 10 parts by weight, the amount of the charge controlling agent adhered to the toner surface is insufficient, which results in separation of the charge controlling agent from the toner surface when the toner is used. In case that the charge controlling agent is fixedly adhered to the toner surface, a stable level of charge amount can be obtained with such a very small amount of the charge controlling agent as noted above. Moreover the calix arene compound of the invention is white in color, it becomes possible to provide a color toner which has good chargeability and is capable of forming a clear color image.

When the calix arene compound expressed by the general formula [I] is to be contained in the interior of the toner, the compound is used in a particle size of not more than 5 μm, preferably not more than 3 μm, and more preferably not more than 1 μm. If the compound is used in a particle size larger than 5 μm, the resulting dispersion is not uniform, which in turn results in non-uniform charge characteristics. When the calix arene compound is to be adhered to the toner surface, the compound is used in a particle size of not more than 1 μm, preferably not more than 0.5 μm. Use of the compound in a particle size larger than 1 μm is disadvantageous in that uniform adherence and fixation on the toner surface is hindered.

The calix arene compound of the invention, as the charge controlling agent, may be used in combination with any other negative charge-controlling agent. For the purpose of charging stabilization, a positive charge-controlling agent may be added in a small amount. When the charge controlling agent of the invention is used in combination with another charge controlling agent, care is used to ensure that the total amount of the control agents is within the above noted range of usage.

Example of useful negative charge-controlling agents are: "Oil Black" (color index 26150), "Oil Black BY" (made by Orient Kagaku Kogyo K.K.); Metal Complex Salicylate E-81 (made by Orient Kagaku Kogyo); thioindigo pigments, sulfonyl amine derivative of copper phthalocyanine, and "Spilon Black TRH" (made by Hodogaya Kagaku K.K.); "Bontron S-34" (made by Orient Kagaku Kogyo K.K.); "Nigrosine SO" (made by Orient Kagaku Kogyo .K.); "Sele Schbaltz" (R)G (made by Farbenfabriken Bayer K.K.);

"Chromogen Schvaltz ETOO (C. I. No. 14645); "Azo Oil Black" (R) (made by National Aniline); and various kinds of borons and calcium compounds.

Examples of useful positive charge controlling agents are: "Nigrosine Base EX (made by Orient Kagaku Kogyo K.K.); "Quaternary Ammonium Salt P-51 (made by Orient Kagaku Kogyo K.K.); "Bontron N-01 (made by Orient Kagaku Kogyo K.K.); "Sudan Chief Schwaltz BB" (solvent black 3: color index 26150); "Fett Schwaltz HBN" (C. I. No. 26150); "Brilliant Spirit Schwaltz TN (made by Farbenfabriken Bayer K.K.); "Zabon Schwaltz X (made by Hoechst); and alkoxylated amines, alkyl amide, chelate molybdate pigments, and imidazole compounds. For the purpose of charging stabilization, the calix arene compound of the invention may be added in a small amount to a positively chargeable toner incorporating a positive charge-controlling agent.

The resin for the toner is not particularly limited insofar as the resin is generally used as a binder in the manufacture of toners. For example, thermoplastic resins, such as styrene, (metha)acrylic, olefin, amide, carbonate, polyether, polysulfone, polyester, and epoxy resins; thermosetting resins, such as urea, urethane and epoxy resins; and copolymers and polymer blends of these resins are available for use as such. Synthetic resins available for use in the toner of the invention are not limited to those in a complete state of polymer as in thermoplastic resins, for example, but those in the state of oligomer or prepolymer as in thermosetting resins, as well as those polymers which partially include a prepolymer, a crosslinking agent, or the like, may be used as well.

Monomers useful as resin constituents in the present invention specifically include those exemplified below. Useful vinyl monomers include, for example, styrene, o-methylstyrene, m-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene, and derivatives of these styrenes. Among these monomers, styrene is most preferred.

As other vinyl monomers may be exemplified, for example, ethylene, ethylenic unsaturated mono-olefins, such as propylene, butylene, and isobutylene; vinyl halides, such as vinyl chloride, vinylidene chloride, vinyl bromide, and vinyl fluoride; vinyl esters, such as vinyl acetate, vinyl propionate, vinyl benzoate, and vinyl lactate; oc-methylene aliphatic ester monocarboxylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate, α-chloromethyl acrylate, methyl methacrylate, ethyl methacrylate, propyl methacrylate, n-butyl methacrylate, isobutyl methacrylate, propyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; (metha)acrylic derivatives, such as acrylonitrile, methacrylonitrile, and acrylamide; vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinyl pyrrole, N-vinyl carbazole, N-vinyl indole and N-vinyl pyrrolidone; and vinyl naphthalenes.

As monomers for amide resins may be exemplified by caprolactam, and dibasic acids, such as terephthalic acid, isophthalic acid, adipic acid, maleic acid, succinic acid, sebacic acid, and thioglycolic acid. Also, diamines are mentioned as such, including ethylene diamine, diaminoethyl ether, 1,4-diamino benzene, and 1,4-diaminobutane.

Useful monomers for urethane resins include, for example, di-isocyanates, such as p-phenylene di-isocyanate, p-xylene di-isocyanate, and 1,4-tetramethylene di-isocyanate; and glycols, such as ethylene glycol, diethylene glycol, propylene glycol, and polyethylene glycol.

Useful monomers for urea resins include, for example, di-isocyanates, such as p-phenylene di-isocyanate, p-xylene di-isocyanate, and 1,4-tetramethylene di-isocyanate; and diamines, such as ethylene diamine, diaminomethyl ether, 1,4-diaminobenzene, and 1,4-diaminobutane.

Useful monomers for epoxy resins include, for example, amines, such as ethylamine, butylamine, ethylene diamine, 1,4-diaminobenzene, 1,4-diaminobutane, and monoethanolamine; and diepoxy resins, such as diglycidyl ether, ethylene glycol diglycidyl ether, bisphenol A diglycidyl ether, and hydroquinone diglycidyl ether.

Useful monomers for polyester resins which are available for use as polyol components include ethylene glycol, diethylene glycol, triethylene glycol, 1,2-propylene glycol, 1,3-propylene glycol, 1,4-butanediol, 1,3-butanediol, 2,3-butanediol, 1,5-pentanediol, 1,6-hexanediol, neopentylglycol, 2-ethyl-1,3-pentanediol, 2,2,4-trimethyl-1,3-pentanediol, 1,4-bis(2-hydroxymethyl)cyclohexane, 2,2-bis(4-hydroxypropoxy phenyl)propane, bisphenol A, hydrogenated bisphenol A, and polyoxyethylated bisphenol A. Those for use as polybasic acid components include unsaturated carboxylic acids, such as maleic acid, fumaric acid, mesaconic acid, citraconic acid, itaconic acid, gluconic acid, 1,2,4-benzene tricarboxylic acid, and 1,2,5-benzene tricarboxylic acid; and saturated carboxylic acids, such as phthalic acid, terephthalic acid, isophthalic acid, succinic acid, adipic acid, malonic acid, sebacic acid, 1,2,4-cyclohexane tricarboxylic acid, 1,2,5-cyclohexane tricarboxylic acid, 1,2,4-butane tricarboxylic acid, 1,3-dicarboxy-2-methylmethylcarboxy propane, and tetra(methylcarboxy) methane. Also, anhydrides of these acids, and their esters with lower alcohol may be used. Specifically, maleic anhydride, phthalic anhydride, tetrahydrophthalic anhydride, hexahydrophthalic anhydride, endomethylene tetrahydrophthalic anhydride, tetrachlorophthalic anhydride, tetrabromophthalic anhydride, dimethyl terephthalate may be mentioned as such.

Polyester resins useful for the purpose of the invention are not limited to those polymerized from a combination of one kind of polyol component and one kind of polybasic acid component as respectively selected from the above exemplified polyols and polybasic acids. Those polymerized from a combination of respective components employed in pluralities are also useful. For the polybasic acid components in particular, an unsaturated carboxylic acid and a saturated carboxylic acid, or a polycarboxylic acid and a polycarboxylic anhydride, are often used in combination.

It is desirable that a thermoplastic resin is loaded with a low molecular-weight polyolefin wax. The content of such a wax is 1–10 parts by weight, preferably 2–6 parts by weight, relative to 100 parts by weight of the thermoplastic resin. The compound expressed by the general formula [I] according to the invention exhibits good negative charge control performance with respect to such a composition and, in effect, can provide sufficient charging characteristics for practical purposes.

Recently, greater attention has been directed toward higher-speed copying technique. For use in such high speed development, toners are required to have improved performance characteristics, such as short-time fixing performance to transfer paper and improved separability from the fixing roller.

For purposes of high speed development, therefore, with respect to homopolymers and/or copolymers synthesized from the foregoing styrene monomers, (metha)acrylic monomers or (metha)acrylate monomers, or the aforementioned polyester resins, it is desirable that their molecular weight, more specifically, number-average molecular weight (Mn), weight-average molecular weight (Mw), and Z-average molecular weight (Mz), should satisfy the following relationships:

$$1{,}000 \leqq Mn \leqq 7{,}000$$

$$40 \leqq Mw/Mn \leqq 70$$

$$200 \leqq Mz/Mn \leqq 500$$

Further, in respect of number-average molecular weight, it is desirable to use those which meet the relation $2{,}000 \leqq Mn \leqq 7{,}000$.

For use as toner component resins, polyester resins are receiving attention because of their resistance to vinyl chloride, light-transmittance necessary for light-transmittable toners, and adhesivity to OHP sheets. When used in light-transmittable toners, preferable polyester resin is a linear polyester having a glass transition temperature of 55° to 70° C. and a softening point of 80° to 150° C. When used in oilless fixing toners, preferable resin has a glass transition temperature of 55° to 80° C. and a softening point of 80° to 150° C. and contains a gel component of 5–20 wt %.

For use in a low-temperature fixing toner, it is desired that such resin should have a flow starting temperature of not more than 100° C. at flow tester, and a softening temperature of not more than 110° C.

The calix arene compound expressed by the general formula [I] of the invention may be used in a toner composed principally of a linear urethane-modified polyester (C) as obtained by reacting diisocyanate (B) with a linear polyester resin (A). The linear urethane-modified polyester referred to herein is composed principally of a linear urethane-modified polyester resin (C) which is obtained by reacting 0.3–0.95 mol of diisocyanate (B) with 1 mol of a linear polyester resin (A) composed of dicarboxylic acid and diol and having a number-average molecular weight of 1,000–2,000 and an acid value of not more than 5, with its terminal group composed substantially of a hydroxyl group. The resin (C) should have a glass transition temperature of from 40° to 80° C. and an acid value of not more than 5. The dicarboxylic acid, diol and diisocyanate are selected from those enumerated earlier.

The calix arene compound of the invention may be used for a toner comprising a vinyl-modified polyester resin obtained by graft polymerizing and/or block polymerizing a vinyl monomer component containing a vinyl monomer and an amino group-containing vinyl monomer with an unsaturated polyester component composed at least of an aliphatic unsaturated dibasic acid and a polyvalent alcohol.

For a colorant to be contained in a toner for developing an electrostatic latent image, various kinds of pigments and dyes, organic and inorganic, in various colors, as exemplified below, can be used.

Black color pigments available for use include carbon black, copper oxide, manganese dioxide, aniline black, and activated charcoal.

Yellow pigments available for use include yellow lead, zinc yellow, cadmium yellow, yellow oxide, mineral fast yellow, nickel titanium yellow, nables yellow, naphthol yellow S, Hansa yellow G, Hansa yellow 10G, benzidine yellow G, benzidine yellow GR, quinoline yellow lake, permanent yellow NCG, and tartrazine lake.

Orange color pigments available for use include red yellow lead, molybdenum orange, permanent orange GTR, pyrazolone orange, vulcan orange, indanthrene brilliant orange RK, benzidine orange G, and indanthrene brilliant orange GK.

Red pigments available for use include red iron oxide, cadmium red, red lead oxide, mercury sulfide, cadmium, permanent red 4R, lithol red, pyrazolone red, watching red, calcium salt, lake red D, brilliant carmine 6B, eosine lake, rhodamine lake B, alizarin lake, and brilliant carmine 3B.

Violet pigments available for use include manganese violet, fast violet B, and methyl violet lake.

Blue pigments available for use include Prussian Blue, cobalt blue, alkali blue lake, victoria blue lake, phthalocyanine blue lake, metal-free phthalocyanine blue, partially chlorinated phthalocyanine blue, fast sky blue, and indanthrene blue BC.

Green pigments available for use include chrome green, chromic oxide, pigment green B, malachite green lake, and final yellow green G.

White pigments available for use include zinc oxide, titanium oxide, antimony white, and zinc sulfide.

Extender pigments available for use include baryte powder, barium carbonate, clay, silica, white carbon, talc, and alumina white.

Also, various dyes, such as basic, acid, disperse and direct dyes, can be used, including nigrosine, methylene blue, rose Bengal, quinoline yellow, and ultramarine blue.

These colorants may be used alone or in combination. It is desirable that a content of the colorant or colorants ia 1–20 parts by weight, preferably 2–10 parts by weight, relative to 100 parts by weight of the component resin of a toner. If the content is larger than 20 parts by weight, the fixing properties of the toner are lowered. If the content is less than 1 part by weight, a desired image-density cannot be achieved.

When the toner is to be used as a light transmittable toner, various pigments and dyes of various colors are available for use as colorants, as exemplified below.

Useful yellow pigments include, for example, C. I. 10316 (naphthol yellow S), C. I. 11710 (Hansa yellow 10G), C. I. 11660 (Hansa yellow 5G), C. I. 11670 (Hansa yellow 3G), C. I. 11680 (Hansa yellow G), C. I. 11730 (Hansa yellow GR), C. I. 11735 (Hansa yellow A), C. I. 11740 (Hansa yellow RN), C. I. 12710 (Hansa yellow R), C. I. 12720 (pigment yellow L), C. I. 21090 (benzidine yellow), C. I. 21095 (benzidine yellow G), C. I. 21100 (benzidine yellow GR), C. I. 20040 (permanent yellow NCG), C. I. 21220 (vulcan fast yellow 5), and C. I. 21135 (vulcan fast yellow R).

Useful red pigments include, for example, C. I. 12055 (Sterling I), C. I. 12075 (permanent orange), C. I. 12175 (lithol fast orange 3GL), C. I. 12305 (permanent orange GTR), C. I. 11725 (Hansa yellow 3R), C. I. 21165 (vulcan fast orange GG), C. I. 21110 (benzidine orange G), C. I. 12120 (permanent red 4R), C. I. 1270 (para red), C. I. 12085 (fire red), C. I. 12315 (brilliant fast scarlet), C. I. 12310 (permanent red FR2), C. I. 12335 (permanent red F4R), C. I. 12440 (permanent red FRL), C. I. 12460 (permanent red FRLL), C. I. 12420 (permanent red F4RH), C. I. 12450 (light fast red toner B), C. I. 12490 (permanent carmine FB), and C. I. 15850 (brilliant carmine 6B).

Useful blue pigments include, for example, C. I. 74100 (metal-free phthalocyanine blue), C. I. 74160 (phthalocyanine blue), and C. I. 74180 (fast sky blue).

These colorants may be used alone or in combination. It is desirable that a content of the colorant or colorants is 1–10 parts by weight, preferably 2–5 parts by weight, relative to 100 parts by weight of the resin contained in toner particles. If the content is larger than 10 parts by weight, the fixing and light-transmittable characteristics of the toner are deteriorated. If the content is less than 1 part by weight, a desired image-density cannot be achieved.

In case that carbon black is used as a colorant in a toner, preferable carbon black has a pH of lower than 7. A carbon black having a pH of lower than 7 exhibits good dispersion in a binder resin because of the presence of a polar group on the surface of the carbon black. Especially when the colorant is used in a smaller particle-size toner having a mean particle size of, say, from 2 to 9 μm, the dispersion effect is more pronounced.

When used in a negatively chargeable toner, such carbon black contributes toward the enhancement of charging performance, more particularly negative charging performance, of the toner.

For the purpose of improving dispersibility of the colorant in a binder resin, a carbon black graft polymer may be used as the colorant.

To obtain the carbon black graft polymer, the reactivity of a functional group (e.g., —OH, —COOH, >C=O, or the like) present on the surface of the carbon black may be utilized. For reaction with carbon black, polymers having a reactive group capable of ready reaction with the functional group present on the surface of the carbon black may be used without particular limitation. Examples of the reactive groups which can readily react with any functional group present on the surface of the carbon black are aziridine, oxazoline, N-hydroxyalkylamide, epoxy, thioepoxy, isocyanate, vinyl, amino, and silicon-based hydrolyzable groups. Any polymer having at least one kind of group selected from these groups may be effectively used for the purpose.

As examples of polymers having such reactivity with carbon black may be exemplified by vinyl polymers, polyesters and polyethers, which have at least one such reactive group within their molecules. A molecular weight of the polymer having such reactivity is not particularly limited, but from the standpoints of processing effect on the carbon black and operation convenience during the reaction with the carbon black, a number-average molecular weight range of from 500 to 1,000,000 is preferred. More preferably the range is from 1,000 to 500,000, most preferably from 2,000 to 100,000. It is required that there must be one such reactive group in one molecule on the average. However, the larger the number of such reactive group, the less favorable is the dispersion of the carbon black polymer in the other component materials. On the average, therefore, the presence of 1–5 of such reactive groups in one molecule is preferred. More preferably, the number is 1 or 2, and most preferably 1.

To obtain a polymer having such reactivity with carbon black, it is possible to employ, for example, a method in which a polymerizable monomer having aforesaid reactive group in its molecular structure is polymerized with some other polymerizable monomer according to a conventional procedure, as required, or a method in which a compound having such reactive group within its molecules is caused to react with a polymer having a group reactable with the compound. In the present invention, from the view point of reactivity with the functional group present on the surface of the carbon black, in particular, it is preferable to use a polymer having as a reactive group or groups one or more kinds of groups selected from the group consisting of aziridine, oxazoline, N-hydroxyalkylamide, epoxy, thioepoxy, and isocyanate groups, more preferably a polymer having as a reactive group or groups one or more kinds of groups selected from the group consisting of aziridine, oxazoline and epoxy groups, most preferably at least one reactive group selected from the group consisting of aziridine and oxazoline groups.

The toner of the present invention may incorporate an offset-preventing agent for improvement of its fixing characteristics. For the offset-preventing agent, various kinds of waxes, more specifically polyolefinic waxes, such as low molecular-weight polypropylene and polyethylene waxes, and oxidized type polypropylene and polyethylene waxes, and natural waxes, such as carnauba wax, rice wax and montan wax can be advantageously employed. The offset-preventing agent contained at an amount of 1–10 parts by weight, preferably 2–6 parts by weight, relative to 100 parts by weight of a binder resin. For the offset-preventing agent, it is desirable to use a wax having a number-average molecular weight (Mn) of from 1,000 to 20,000, and a softening point (Tm) of from 80° to 150° C. If the number-average molecular weight (Mn) is less than 1,000, or if the softening point (Tm) is lower than 80° C., uniform dispersion of the wax in the synthetic resin component of a synthetic resin-coating layer is hindered and the wax tends to exude to the surface of the toner. This will have an unfavorable effect on the storage of the toner or in the copying process. Further, such exudation will contaminate photosensitive member, resulting in filming or the like. If the number-average molecular weight is greater than 20,000 or if Tm is higher than 150° C., the compatibility of the wax with the resin is unacceptably lowered and, in addition, the offset-preventive performance of the wax at high temperatures can no longer be expected. When the wax is to be used in combination with a synthetic resin having a polar group from the compatibility view point, it is desirable to use a wax having a polar group.

For purposes of improving toner fluidity, a fluidizing agent may be admixed with the toner of the present invention. For the fluidizing agent, various metal oxides, such as aluminum oxide, titanium oxide, silica-aluminum oxide mixture, and silica-titanium oxide mixture, or magnesium fluoride may be used. Such an agent may be incorporated into the toner.

A cleaning auxiliary may be added to the toner. For such auxiliary may be used inorganic fine particles (as earlier mentioned for use as fluidizing agent), metallic soap such as stearate, and fine particles of various synthetic resins, such as fluorine, silicon, styrene-(metha)acrylic, benzoguanamine, melamine, and epoxy resins. Useful as such synthetic resin particles are various organic fine particles of styrene, (metha)acrylic, olefin, fluorine-containing, nitrogen-containing (metha)acrylic, silicon, benzoguanamine and melamine resins which are granulated by wet methods, such as emulsion polymerization process, soap-free emulsion polymerization process and non-aqueous dispersion polymerization process, or vapor phase methods. Such synthetic resin fine particles are configured to be substantially spherical and used within a mean particle size range between 0.01 and 3 μm which is smaller than a mean particle size of the toner, preferably from 0.05 to 2 μm. A content of such particles is 0.01–10 wt %, preferably 0.1–5 wt %, more preferably 0.1–2 wt %, relative to 100 wt % of the toner.

The toner of the present invention may be used as a magnetic toner. In this case, particles of a known magnetic material are dispersed in the binder resin. For the magnetic material may be used, for example, metals exhibiting ferromagnetism, such as cobalt, iron and nickel; alloys of such metals as cobalt, iron, nickel, aluminum, lead, magnesium, zinc, antimony, beryllium, bismuth, cadmium, calcium, manganese, selenium, titanium, tungsten and vanadium; and mixtures, oxides, and calcined products of these metals. Such magnetic material may be added in an amount of 1 to 80 parts by weight, preferably 5 to 60 parts by weight, relative to 100 parts by weight of the binder resin component of a toner.

The toner of the invention preferably has a mean particle size of 2 to 20 μm. Especially for purposes of reproducing a highly minute image, it is preferable that the toner has a smaller mean particle size range of 2 to 9 μm. In case that a smaller particle size is adopted, particle size uniformity is also required of the charge controlling agent contained in the toner. The calix arene compound can be easily made smaller in particle size and has good dispersibility in the resin. The calix arene compound can therefore be advantageously used with the toner.

The toner of the invention is applicable to both two-component developer and single-component developer (magnetic and non-magnetic). Where the toner is used as a two-component developer, any known carrier, such as ferrite carrier, coating carrier, iron powder carrier, binder-type carrier, or a carrier having a composite charge surface, may be used.

The toner of the invention may be advantageously used in a conventional developing method such that toner is passed through a clearance between a toner levelling member, which comprises a blade and a roller, and a toner supporting member, whereby a thin toner layer is formed on the surface of the toner supporting member. The toner supporting member may be used as a developing roller or as a toner supply roller for the developing roller.

The calix arene compound of the invention may be applied to a photoconductive toner.

The toner prepared in the above described manner can be used for all developing purposes involved in rendering an electrostatic latent image visible in various conventional operations in electronic photography, electrostatic recording and electrostatic printing.

The calix arene compound of the invention will now be explained as to the manner in which it is used as a charge-giving material for a charge-giving member.

The charge-giving member functions to impart adequate electrical charge to the toner, and a blade, a sleeve and a carrier are conventionally known as such.

The calix arene compound expressed by the general formula [I] may be directly contained in the charge-giving member, or may be contained in a coated layer of resin or the like provided on the surface of the charge-giving member which contains the calix arene compound. Through such arrangement is it possible to apply adequate charge to the toner. The calix arene compound can be advantageously incorporated in blades and sleeves which are used in the single-component development system.

There are various types of single-component systems, but theoretically such a system comprises a drum-like sleeve (toner transferring member) arranged between a photosensitive drum on which is formed an electrostatic latent image to which toner is transferred and a toner container in which a mono-component toner is stored, and a blade (a toner layer thickness levelling member) pressed against the toner transferring member, the blade concurrently having a function to charge the toner, or in its another form, comprises the sleeve and the blade being arranged in spaced opposed relation. As the toner transferring member moves, the toner layer is thinned by the toner layer levelling member so that the toner layer is charged to such polarity and such charge level as is required for development, whereby toner is suitably supplied to and adsorbed onto the photosensitive drum so that the latent image on the drum is rendered visible.

The blade is usually made of metal such as phosphor bronze, stainless steel, aluminum or iron, or resin such as urethane, nylon, teflon, silicon, polyacetal, polyester, polyethylene, styrene, acrylic, styrene-acrylic, melamine or epoxy resin, or synthetic rubber such as ethylene propylene rubber, fluororubber, or polyisoprene rubber or natural rubber. The blade is held in line contact with the surface of the sleeve and is pressed thereagainst. According to the invention, such blade surface is coated with a resin layer which contains the calix arene compound expressed by the general formula [I]. When the blade is made of resin, the calix arene compound may be incorporated into the blade.

When a coating layer containing the calix arene compound of the invention is formed on the blade, a binder resin is used. The binder is not particularly limited in material insofar as the material is usually used as a binder in conventional hard coating. For example, thermoplastic resins, such as styrene, (metha)acrylic, olefin, amide, polycarbonate, polyether, polysulfon, polyester, silicone, and polyacetal; thermosetting resins, such as epoxy, urea, and urethane; and copolymers and polymer blends are used as such. It is also possible to arrange that the compound of the invention is dispersed in a metal alkoxide, such as Si, Ti, Fe, Co, or Al, and then a coating layer is formed on the sleeve surface by applying the dispersion as a binder, then the coating layer being heat-treated. In this way, a ceramic hard coating may be formed which contains the compound of the invention.

In order to ensure uniform dispersion of the calix arene compound of the invention in the coating layer, a particle size of the calix arene compound is not more than 10 μm, preferably not more than 3 μm.

A content of the calix arene compound is 0.01–20 parts by weight, preferably 0.1–10 parts by weight, relative to 100 parts by weight of coating resin. This permits smooth build-up and stable charging. The same content may be used when a ceramic hardcoat layer is to be formed.

Coating is carried out in such a manner that a predetermined amount of the calix arene compound of the invention is dissolved or dispersed in a resin solution prepared by dissolving and/or uniformly dispersing the resin in a suitable solvent, and the resulting solution is coated on the blade according to the known technique, such as spraying, dipping or blading methods. A coating layer is formed to have a thickness of 0.1–500 μm, preferably 0.5–200 μm, more preferably 1–100 μm. If the coating layer is thinner than 0.1 μm, it becomes difficult to control layer thickness uniformly and to form uniform coating layer surface. If the coating thickness is greater than 500 μm, the adhesivity of the layer to the substrate is lowered. When a ceramic material is used as a coating material, conventional techniques, such as hot vapor deposition, spattering, ion plating, chemical vapor deposition, sol-gel, spraying, dipping and blading methods, are also employed. The desired coating thickness corresponds substantially to that in the above described resin coating layer, but a coating thickness range of 0.5–10 μm is preferred.

The sleeve, as a toner transferring member, constitutes a outer periphery of a conductive cylindrical roller made of aluminum, phosphor bronze, stainless steel, or iron. Conventionally, the sleeve is comprised of a cylindrical electroconductive rubber or a cylindrical electroconductive thin metal film (Ni, Al, Ti, Cr, Mo, W, brass, stainless steel, Co—$Al_2O_3$, Pb—$TiO_2$, Pb, Tic, etc.), or a cylindrical resin film (polycarbonate, nylon, polyester, polyethylene, polyurethane, fluororesin, etc.).

The sleeve of the invention comprises a toner transferring member of the conventional type, and a resin layer containing the calix arene compound of the invention which covers the transfer member. When the toner transferring member is comprised of resin film or rubber, the calix arene compound of the invention may be incorporated into the transfer member without covering the member. For this purpose, an amount of the compound contained and the coating method as described earlier may apply in similar manner.

In order to further improve the electrification build-up of the toner and stability of toner chargeability, provision of irregularities on the surface of the sleeve is advantageous. Such surface irregularities can be formed by addition of the calix arene compound, but for ease of such irregularity provision, the use of various kinds of fine particles in conjunction with the compound is effective.

Fine particles available for use in this connection may usually be selected by using the so-called blow-off technique on the basis of their polarity of charging characteristics. Particles of inorganic and organic materials and mixtures thereof can be used. For example, particles of benzoguanamine resins, melamine resins, glass beads, nylon beads, epoxy resins, phenolic resins, aminoacrylic resins, fluororesins, silicon resins, polyester resins, polyethylene resins and fluoroacrylic resins, and inorganic and organic fillers can be used as such. Also, such particles which are hydrophobically treated with a coupling agent are used.

The surface roughness of the sleeve is preferably within a range of 1/10 to 8/10 of the mean particle size of a toner. More specifically, the surface roughness is usually 0.5–10 μm, more preferably 1–5 μm. If the surface roughness is greater than 10 μm, toner may enter surface concaves of a toner transporting member to reduce possible contact of a film thickness-levelling member with toner, with the result that toner transfer and thin toner-layer formation are hindered so that uniform charging of the toner is substantially hindered. If the surface roughness is smaller than 0.1 μm, the effectiveness of the surface roughness is reduced, or in other words the effect of uniform toner charging and the effectiveness of uniform film formed on toner particles are substantially lost. In the present invention, the term "surface roughness" means 10-point average roughness (Rz) described hereinbelow.

Figure 3:
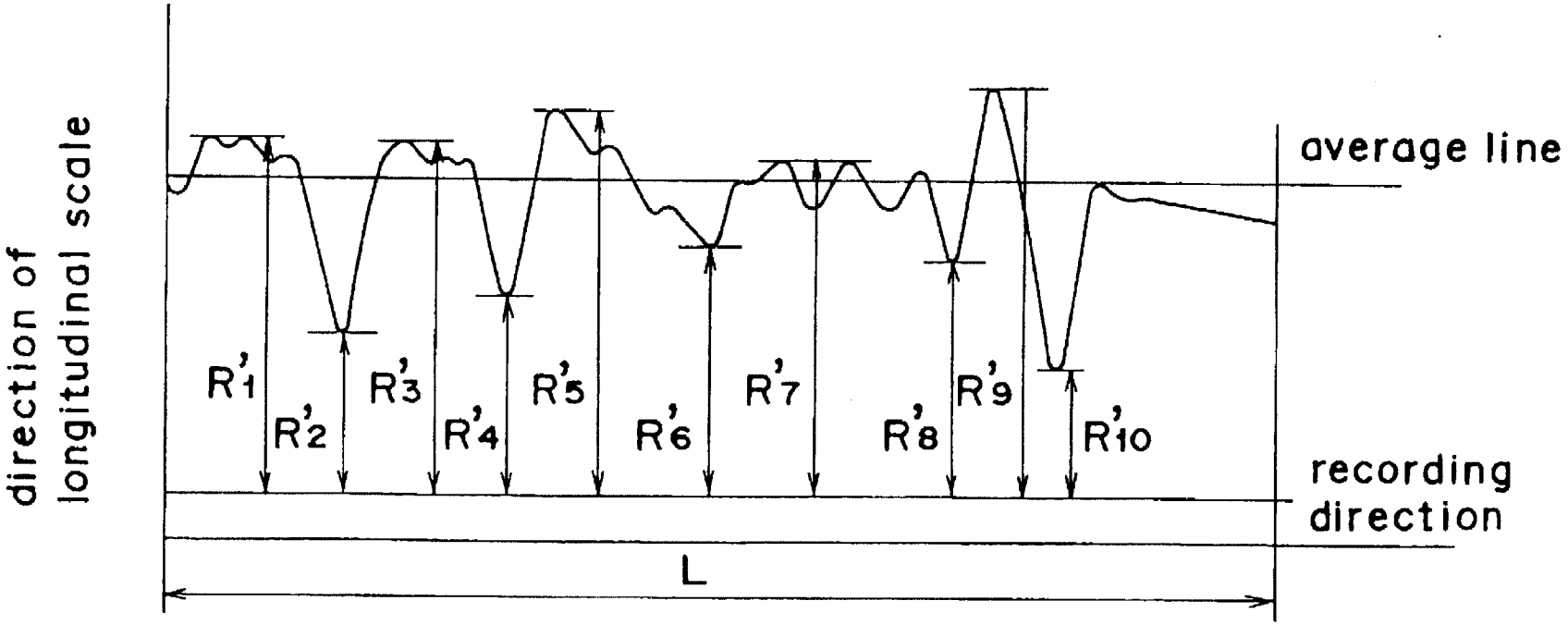
FIG. 3 is to explain a conceptional definition of 10-point average roughness.

In a portion taken a reference length from a section curve, measurement is made from a straight line which does not cross the section curve, in a longitudinal scale factor. Average value of the heights of hills, from the top high to the fifth high, and average value of the heights of furrows, from the top deep to the fifth deep, are taken, the difference between the two averages being expressed in micrometers (μm), which difference is termed 10-point average roughness. Ten-point average roughness can be calculated from Equation [1]. A conceptional definition is illustrated in FIG. 3.

Equation [1]

$$Rz = \frac{(R_1' + R_3' + R_5' + R_7' + R_9') - (R_2' + R_4' + R_6' + R_8' + R_{10}')}{5}$$

in which $R_1'$, $R_3'$, $R_5'$, $R_7'$ and $R_9'$ represent heights of the top high to the fifth high in a portion taken which corresponds to the reference length L, and $R_2'$, $R_4'$, $R_6'$, $R_8'$ and $R_{10}'$ represent depths of the top deep to the fifth deep of the reference length L.

In the present invention, unless otherwise specified, the reference length (L) as given Table 1 below.

TABLE 1

Standard values for reference lengths for measurement of 10-point average roughness

| Range of 10-point average roughness | | Reference length |
|---|---|---|
| Over | Below | mm |
| | 0.8 μmRz | 0.25 |
| 0.8 μmRz | 6.3 μmRz | 0.8 |
| 6.3 μmRz | 25 μmRz | 2.5 |
| 25 μmRz | 100 μmRz | 8 |
| 100 μmRz | 400 μmRz | 25 |

For measurement of such 10-point averages, Feeler Type Surface Roughness Configuration Measuring Apparatus "Surfcom" (made by Tokyo Seimitsu K.K.) may be used, for example.

Figure 2:
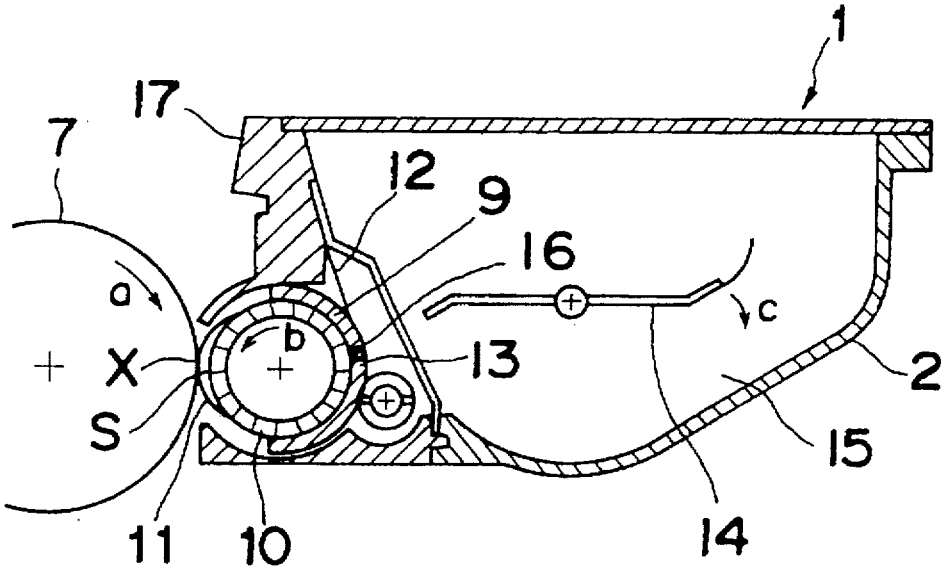
FIG. 2 shows another schematic arrangement of a developing apparatus.

Schematic arrangement of a developing apparatus equipped with the above described blade and sleeve is shown in FIGS. 1 and 2.

The developing apparatus 1 shown in FIG. 1 is arranged at a side of a photosensitive drum 7 driven for rotation in the direction of arrow a. A developing roller 3 is composed of an aluminum-made electro-conductive roller which is covered by a sleeve placed thereon. A bias voltage is applied to the roller for development. Therefore, the sleeve is rendered moderately electrically conductive. For the sleeve, the above mentioned sleeve of the invention is employed. Preferably, the surface of the sleeve is formed with irregularities.

The developing roller 3 is rotatably supported in position and drivingly connected to a driving source (not shown). The outer periphery of the roller 3 is held in circumferential contact with the photosensitive drum 7, and on the back side of the drum 7 a blade 4 for levelling toner layer thickness is pressed against the surface of the sleeve 8. A material containing the above mentioned calix arene compound is used for the blade 4. The blade 4 is preferably formed with irregularities. The material of the invention may be used for both the blade 4 and the sleeve 4, or it may be used for one of them.

An agitator 5 rotates in the direction of arrow c for feeding toner to the surface of the developing roller 3. As the toner passes through the pressure portion between the developing roller 3 and the blade 4, toner is coated uniformly on the surface of the sleeve 8 to a thin layer.

Nextly, the developing apparatus shown in FIG. 2 will be described.

In FIG. 2, the developing apparatus 1 is arranged at a side of the photosensitive drum which is driven to rotate in the direction of arrow a. An elastic drive roller 10 is composed of an electroconductive member made of aluminum or the like with an elastic member made of rubber or the like placed thereon to cover the roller. A bias voltage is applied to the roller for development. Accordingly, the overlying elastic rubber member has a moderate degree of electroconductivity. A thin film member 11 is an endless member having a circumferential length slightly larger than the circumferential length of the elastic drive roller 10, and is externally fitted on the roller 10. A sleeve of the invention which is comprised of a resin material or a resin coat layer containing the calix arene compound is used in the thin film member 11. The elastic drive roller which is fitted with the thin film member 11 is rotatably supported in position and is connected to an unillustrated drive source. At both ends of the drive roller 10 there are disposed sleeve guides 9 for keeping the thin film member 11 in close contact with the outer periphery of the elastic drive roller 10. Therefore, portions of the thin film member 11 which contact the sleeve guide 9 are held in close contact with the outer periphery of the drive roller 10, so that an excess portion of the thin film member 11 which is constructed longer than the peripheral length of the elastic drive roller 10 concentrates on the forepart of the roller 10, whereby a space S is formed between the thin film member 11 and the roller 10 with the result that the outer periphery of the thin film member 11 which covers the space S is held in contact with the periphery of the photosensitive drum 7.

Now, assume that the coefficient of friction between the outer periphery of the elastic drive roller 10 and the inner periphery of the thin film member 11 is $\mu 1$, and the coefficient of friction between the outer periphery of the thin film member 11 and the inner periphery of the sleeve guide 9 is $\mu 2$. Then, the relation $\mu 1 > \mu 2$ holds. Therefore, as the elastic drive roller 10 rotates in the direction of arrow b, the thin film member 11 moves in the same direction, and accordingly the outer surface of the thin film member 11 which cover the space S is allowed to frictionally slide over the surface of the photosensitive drum 7 with a suitable nip kept.

The blade 12 with a round meta rod 16 provided at a front end thereof is mounted on the backside of a support member 17, the support member 17 being disposed on an upper portion of the elastic drive roller 10. A levelling portion of the blade is pressed against the elastic drive roller 10 through the thin film element 11 on the diagonal back side of the roller 10. The round metal rod attached to the front end of the blade 12 is comprised of a resin or a resin coat layer containing the calix arene compound expressed by the general formula [I]. The calix arene compound of the invention may be applied to both or either one of the thin film member 11 and the round metal rod 16.

A rear portion of the developing tank 2 is formed as a toner storing tank 15, with an agitator 14 being mounted in the toner storing tank 15 for being driven for rotation in the direction of arrow c. The agitator 14 acts to prevent the toner housed in the tank 15 from blocking or the like while moving the toner in the direction of arrow c. The toner used may be of the non-magnetic, mono-component type.

The manner of operation of the developing apparatus of the construction illustrated in FIG. 2 will now be explained.

Assume that the elastic drive roller 10 and the agitator 14 are in rotation in the directions of arrow b and arrow c respectively. The toner within the toner storing tank 15 is forcedly moved in the direction of arrow c under the agitation force of the agitator 14.

Whilst, the thin film member 11 is moved in the direction of arrow b under the force of its friction with the elastic drive roller 10, and the toner which is in contact with the thin film member 11 is provided with a transport force because of its contact with the thin film member 11 and under an electrostatic force. The toner is taken into a wedge-like take-up portion defined between the thin film member 11 and the round metal rod 16 at the front end of the blade 12. When the toner reaches the press portion of the blade 12, toner is uniformly coated in a thin layer form on the surface of the thin film member 11, being thus triboelectrically charged.

The toner held on the thin film member 11 is conveyed to a position opposed to the photosensitive drum 7 (developing region X) along with the movement of the thin film member 11 which follows the movement of the elastic drive roller 10, and on the basis of a voltage differential between the surface potential of the photosensitive drum 7 and the bias voltage applied to the elastic drive roller 10, the toner adheres to an electrostatic latent image formed on the surface of the drum 7 thereby to form a toner image.

At this point of time, the thin film member 11 which is in contact with the photosensitive drum 7 is in non-contact condition relative to the elastic drive roller 10 with the space S positioned therebetween, and therefore the thin film member 11 is allowed to softly and uniformly contact the photosensitive drum 7 with a suitable nip range, so that a uniform toner image is formed on the electrostatic latent image on the drum 7. Even when a speed difference is caused between the peripheral speed of the photosensitive drum 7 and the speed of the thin film element 11, the toner image already formed on the drum 7 is in no way broken. The toner which has passed through the development region X is subsequently transferred along with the thin film member 11 in the direction of arrow b and again a uniform charged toner is formed on the thin film member 11 at the press portion of the toner layer thickness levelling member 12. Then, the foregoing steps are repeated.

The invention can be also applied to a carrier which constitutes a two-component developer as toner charging means.

Application to such carrier involves no particular limitation, but in general a ferrite or iron carrier coated with a resin, or a binder type carrier in which a resin material is mixed with iron particles or ferrite particles, the mixture being kneaded and pulverized are often used.

In addition, for example, carriers in which a magnetic material is coated with fine particles (organic or inorganic), such as fine polymer particles and magnetic particles, or carriers of a surface modified type may be used.

The calix arene compound expressed by the general formula [I] is contained in a resin layer coated around aforesaid magnetic material or in fine polymer particles. The amount of the compound to be added is suitably determined according to the type of carrier or magnetic powder. In the case of binder type carriers, the general formula [I] compound is contained at an amount of 0.01 to 20 parts by weight, preferably 0.1 to 10 parts by weight. If the content is more than 20 parts by weight, charging stability is hindered when used repeatedly. In the case of surface modified type carriers or resin-coated carriers, the content is 0.001–10 parts by weight, preferably 0.1–5 parts by weight.

Carriers may be manufactured according to the conventional techniques, but in such a way that the calix arene compound of the general formula [I] is contained in the coat layer on the surface of the magnetic material. Specifically, for example, in order to coat core carrier particles with a resin, the resin is dissolved in a solvent in the same way as is done in a conventional method of production of a coat carrier, and the resulting solution is sprayed over the core particles, followed by drying. Carrier core particles and fine polymer particles are mechanically mixed by using Henschel mixer or the like to form a layer of fine polymer particles mechanochemically on the surfaces of the carrier core particles, followed by heating and melting to cause the composite to be dissolved and solidified. The calix arene compound may be dissolved and/or uniformly dispersed in a resin solution in a solvent to form a coat layer, or the calix arene compound may be used together with fine polymer particles to form mechanochemically a coat layer. It is also possible to initially form a resin coat layer, then mechanochemically treat the calix arene compound.

As apparatuses available for the foregoing purposes may be mentioned, for example, autoclave with agitator (made by Taiatsu Garasu Kogyo K.K.); SPIR-A-FLOW (made by Furonto Sangyo K.K); thermotreating impact-type modifier (e.g., "Nara Hybridizer", made by Nara Kikai Seisakusho K.K.); "Angmill" (made by Hosokawa Mikuron K.K.); and SPIRA COTA (made by Okada Seiko).

SYNTHESIS EXAMPLE

Synthesis of Calix Arene Compound 1

P-t-octylphenol (20.4 g) (0.1 mol), 15.0 g of p-t-butylphenol (0.1 mol), 4.4 g of paraformadehyde (0.15 mol) and 0.1 g of a 10N aqueous solution of potassium hydroxide were mixed in 800 ml of xylene while stirring. Water was distilled and removed. The resultant was refluxed for reaction. The contents were left for cooling and filtered. The filtered materials were washed with xylene and dried in vacuo to give white powder. A yield was 71.10% (24.7 g).

The obtained Calix arene compound 1 had the following chemical formula:

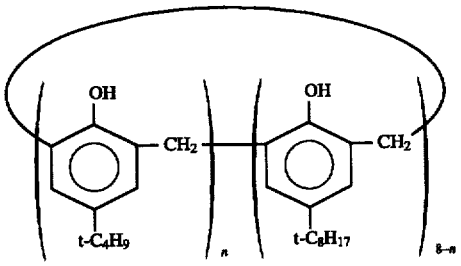

Calix arene compounds having n-value of 0 to 8 is respectively contained at the following ratio (volume ratio). The composition ratio was measured by means of liquid chromatography.

TABLE 2

| n | composition ratio (%) |
|---|---|
| 0 | 0.6 |
| 1 | 1.0 |
| 2 | 9.9 |
| 3 | 25.0 |
| 4 | 31.0 |
| 5 | 22.7 |
| 6 | 8.1 |
| 7 | 0.9 |
| 8 | 0.2 |

Synthesis of Calix Arene Compound 2

Calix arene compound 2 having the formula below was dispensed from 2 g of Calix arene compound 1 by preparative chromatography and purified in methanol to give white powder. A yield was 29.0% (0.58 g).

The obtained Calix arene compound 2 had the following chemical formula:

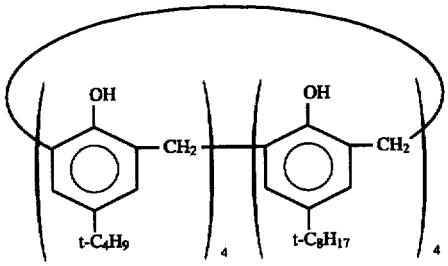

Synthesis of Calix Arene Compound 3

Calix arene compound 3 having the formula below was dispensed from 10 g of Calix arene compound 1 by preparative chromatography and purified in acetone to give white powder. A yield was 6.5% (0.65 g).

The obtained Calix arene compound 3 had the following chemical formula:

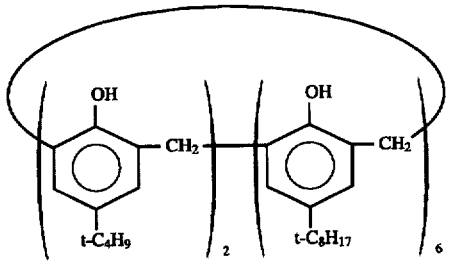

Synthesis of Calix Arene Compound 4

Calix arene compound 4 having the formula below was dispensed from 30 g of Calix arene compound 1 by preparative chromatography and purified in chloroform to give white powder. A yield was 0.8% (0.25 g).

The obtained Calix arene compound 4 had the following chemical formula:

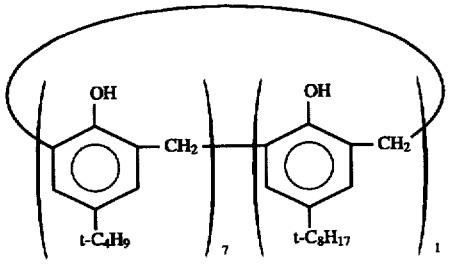

Synthesis of Calix Arene Compound 5

Calix arene compound 1 (10 g) was dissolved in 800 ml of dimethylformamide. Sodium hydride (6 g) (0.25 mol) and 56.8 g of methyl iodide (0.4 mol) were added to the solution. The reaction was carried out 80° C. for 12 hours. The contents were left for cooling and dispersed in 1,000 ml of water. The dispersion was filtered. The filtered materials were washed with water and recrystallized in methanol. White powder was obtained. A yield was 39.0% (4.2 g).

The obtained Calix arene compound 5 had the following chemical formula:

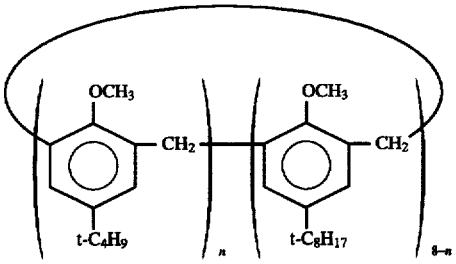

Calix arene compounds having n-value of 0 to 8 is respectively contained at the following ratio (volume ratio). The composition ratio was measured by means of liquid chromatography.

TABLE 3

| n | composition ratio (%) |
|---|---|
| 0 | 0.3 |
| 1 | 1.8 |
| 2 | 11.4 |
| 3 | 26.1 |
| 4 | 30.5 |
| 5 | 19.4 |
| 6 | 8.3 |
| 7 | 1.6 |
| 8 | 0.6 |

Synthesis of Calix Arene Compound 6

Calix arene compound 1 (10 g) was dissolved in 600 ml of dimethylformamide. Sodium hydride (6 g) (0.25 mol) and 68.0 g of propyl iodide (0.4 mol) were added to the solution. The reaction was carried out 90° C. for 24 hours. The contents were left for cooling and dispersed in 2.000 ml of water. The dispersion was filtered. The filtered materials were washed with water and recrystallized in methanol. White-yellow powder was obtained. A yield was 30.3% (3.7 g).

The obtained Calix arene compound 6 had the following chemical formula:

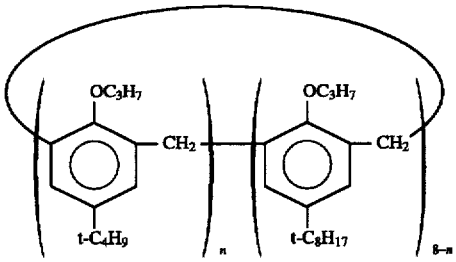

Calix arene compounds having n-value of 0 to 8 is respectively contained at the following ratio (volume ratio). The composition ratio was measured by means of liquid chromatography.

TABLE 4

| n | composition ratio (%) |
|---|---|
| 0 | 0.2 |
| 1 | 1.6 |
| 2 | 9.3 |

TABLE 4-continued

| n | composition ratio (%) |
|---|---|
| 3 | 22.4 |
| 4 | 35.1 |
| 5 | 21.5 |
| 6 | 7.0 |
| 7 | 1.9 |
| 8 | 1.0 |

Synthesis of Calix Arene Compound 7

Calix arene compound 4 (20 g) was dissolved in 700 ml of dimethylformamide. Sodium hydride (12 g) (0.5 mol) and 158.4 g of pentyl iodide (0.8 mol) were added to the solution. The reaction was carried out 90° C. for 48 hours. The contents were left for cooling and dispersed in 2,000 ml of water. The dispersion was filtered. The filtered materials were washed with water and recrystallized in ethanol. White-yellow powder was obtained. A yield was 26.9% (7.6 g).

The obtained Calix arene compound 7 had the following chemical formula:

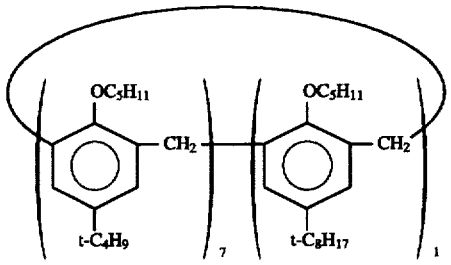

Synthesis of Calix Arene Compound 8

Calix arene compound 1 (10 g), 20 g of sodium hydroxide (0.5 mol) and 86 g of monobromoacetic acid (0.6 mol) were treated in 300 ml of water at 90° C. for 48 hours. The resultant was collected, dried and set. The obtained materials were recrystallized in ethanol to give white powder. A yield was 72.8% (10.3 g).

The obtained Calix arene compound 8 had the following chemical formula:

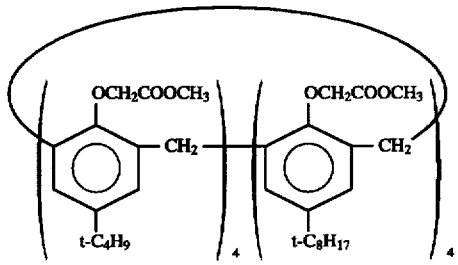

It should be noted that the bonding order in each chemical formula of Calix arene compounds above is not specified.

Application of Calix arene compounds 1–8 to toner

Above calix arene compounds 1–8 were applied to various types of toner for developer.

EXAMPLE 1

| ingredients | parts by weight |
|---|---|
| Styrene-n-butyl methacrylate (softening point: 132°, glass transition point: 60° C.) | 100 |
| Carbon black (MA#8, pH3) (made by Mitsubishi Kasei K.K.) | 8 |
| Calix arene compound 1 | 5 |

The above ingredients were sufficiently mixed in a ball mill. The mixture was kneaded on three rolls heated to 140° C. The kneaded material was left to stand for cooling and pulverized coarsely by means of a feather mill and further pulverized finely by a jet mill.

The pulverized material was air-classified to give fine particles of a mean particle size of 8 μm.

Hydrophobic silica R-974 (mean particle size of 17 μm, made by Aerosil K.K.) of 0.1 part by weight was added to the above obtained fine particles of 100 parts by weight. The mixture was treated in Henschel mixer at 1,000 rpm for 1 minute to give Toner 1-1.

EXAMPLE 2

Toner 1-2 of a mean particle size of 8 μm was obtained in a manner similar to Example 1, except that 30 parts by weight of magnetic particles (ferrite fine particles MFP-2, made by TDK K.K.) were added.

EXAMPLE 3

| ingredients | parts by weight |
|---|---|
| polyester resin (Tafton NE1110, made by Kao K.K.) | 100 |
| Carbon black (Mogul L, Cabot K.K.) | 8 |
| Calix arene compound 2 | 3 |
| Carnauba wax of free aliphatic acid-removed type (melting point: 85° C., acid value: 0.5) | 1.5 |

The above ingredients were sufficiently mixed in Henschel mixer (made by Mitsui Miike Kakoki K.K.). The mixture was kneaded in a biaxial kneader. The kneaded material was left to stand for cooling and pulverized coarsely by means of a feather mill and further pulverized finely by a jet mill. The pulverized material was air-classified to give fine particles of a mean particle size of 8 μm.

Hydrophobic silica H-2000 (mean particle size of 17 μm, made by Wacker K.K.) of 0.2 parts by weight was added to the above obtained fine particles of 100 parts by weight. The mixture was treated in Henschel mixer at 1,000 rpm for 1 minute to give Toner 1-3.

EXAMPLE 4

Toner 1-4 of a mean particle size of 8 μm was obtained in a manner similar to Example 3, except that 5 parts by weight of red pigment lake red C (made by Dainichi Seika K.K.) were used instead of carbon black in Example 3.

EXAMPLE 5

| ingredients | parts by weight |
|---|---|
| polyester resin (Tafton NE382, made by Kao K.K.) | 100 |
| Phthalocyanine pigment (made by Dainichi Seika K.K.) | 5 |
| Calix arene compound 3 | 3 |

The above ingredients were sufficiently mixed in a ball mill. The mixture was kneaded on three rolls heated to 140° C. The kneaded material was left to stand for cooling and pulverized coarsely by means of a feather mill and further pulverized finely by a jet mill. The pulverized material was air-classified to give fine particles of a mean particle size of 7 μm.

Hydrophobic silica (H-2000 made by Wacker K.K.) of 0.3 parts by weight and hydrophobic alumina (RX-C, made by Nippon Aerosil K.K.) of 0.5 parts by weight were added to the above obtained fine particles of 100 parts by weight. The mixture was treated in Henschel mixer at 1,000 rpm for 1 minute to give Toner 1-5.

Comparative Example 1

Toner 1-A of a mean particle size of 8 μm was obtained in a manner similar to Example 1, except that Calix arene compound was not added.

Comparative Example 2

Toner 1-B of a mean particle size of 8 μm was obtained in a manner similar to Example 1, except that p-tert-butyl Calix (7) arene represented by the following formula:

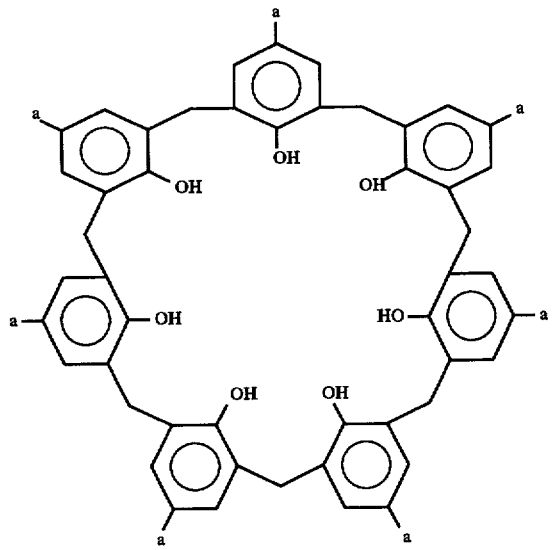

a = $-C(CH_3)_3$ was used instead of Calix arene compound 1.

Comparative Example 3

Toner 1-C of a mean particle size of 8 μm was obtained in a manner similar to Example 3, except that dye of chromium complex type of 3 parts by weight was added instead of Calix arene compound 2.

EXAMPLE 6

| ingredients | parts by weight |
|---|---|
| Styrene-n-butyl methacrylate (softening point: 132°, glass transition point: 60° C.) | 100 |
| Carbon black (MA#8, pH3) (made by Mitsubishi Kasei K.K.) | 8 |
| Polypropylene of low molecular weight (Viscol 550P, made by Sanyo Kasei Kogyo K.K.) | 5 |
| Calix arene compound 4 | 3 |

The above ingredients were sufficiently mixed in a ball mill. The mixture was kneaded on three rolls heated to 140° C. The kneaded material was left to stand for cooling and pulverized coarsely by means of a feather mill and further pulverized finely by a jet mill. The pulverized material was air-classified to give fine particles of a mean particle size of 8 μm.

Hydrophobic silica R-974 (mean particle size of 17 μm, made by Nippon Aerosil K.K.) of 0.1 part by weight was added to the above obtained fine particles of 10 parts by weight. The mixture was treated in Henschel mixer at 1,000 rpm for 1 minute to give Toner 2-1.

EXAMPLE 7

| ingredients | parts by weight |
|---|---|
| polyester resin (Tafton NE1110, made by Kao K.K.) | 100 |
| Carbon black (pH:3, Mogul L, Cabot K.K.) | 8 |
| oxdized-type polypropylene of low molecular weight | 4 |
| Calix arene compound 5 | 3 |

The above ingredients were sufficiently mixed in Henschel mixer (made by Mitsui Miike Kakoki K.K.). The mixture was kneaded in a biaxial kneader (made by Ikegai Tekko K.K.). The kneaded material was left to stand for cooling and pulverized coarsely by means of a feather mill and further pulverized finely by a jet mill. The pulverized material was air-classified to give fine particles of a mean particle size of 8 μm.

Hydrophobic silica H-2000 (mean particle size of 17 μm, made by Wacker K.K.) of 0.2 parts by weight was added to the above obtained fine particles of 100 parts by weight. The mixture was treated in Henschel mixer at 1,000 rpm for 1 minute to give Toner 2-2.

EXAMPLE 8

Polyoxyethylene(2)-2,2-bis(4-hydroxyphenyl) propane (68 parts by weight), 16 parts by weight of isophthalic acid, 16 parts by weight of terephthalic acid, 0.3 parts by weight of maleic anhydride, 0.1 parts by weight of dibutyltin oxide were placed in a flask and treated under nitrogen atmosphere at 230° C. for 24 hours. The treated materials were taken out of the flask to give polyester resin. The resultant polyester had a weight-average molecular weight of 9,800.

The obtained polyester of 50 parts by weight was dissolved in xylene of 50 parts by weight in a flask. Temperature was risen to reflux xylene. While refluxing xylene, a solution containing 13 parts by weight of styrene, 2 parts by weight of methyl methacrylate and 0.6 parts by weight of azobisisobutyronitrile was added dropwise under nitrogen atmosphere for 30 minutes. After dropping, the temperature was kept for 30 minutes. Xylene was removed in vacuo to give a polyester resin modified by styrene-acrylic modification having a weight-average molecular weight of 11,700, Mw/Mn=2.8, a melt viscosity of $5\times10^4$ poise at 100° C. and a glass transition temperature of 60° C.

The melt viscosity was measured by a flow tester CFT-500 made by Shimazu Seisakusyo K.K. under conditions of a nozzle diameter of 1 mm, a nozzle length of 1 mm, a load of 30 kg and a temperature-rising rate of 3° C./min.

| ingredients | parts by weight |
|---|---|
| Polyester resin modified by styrene-Acrylic modification above | 100 |
| Organic pigment, Lionol Yellow YG-1310 | 2.5 |
| Calix arene compound 6 | 2 |

The above ingredients were sufficiently mixed in Henschel mixer. The mixture was kneaded in a biaxial kneader. The kneaded material was left to stand for cooling and pulverized coarsely by means of a feather mill and further pulverized finely by a jet mill. The pulverized material was air-classified to give fine particles of a mean particle size of 8 μm.

Hydrophobic silica H-2000 (made by Wacker K.K.) of 0.3 parts by weight and hydrophobic titanium oxide T-805 (made by Degussa K.K.) of 0.5 parts by weight were added to the above obtained fine particles of 100 parts by weight. The mixture was treated in Henschel mixer at 1,500 rpm for 1 minute to give Toner 3-1.

EXAMPLE 9

A 5-liter four-necked flask equipped with a condenser, a water separator, a $N_2$-gas inlet, a thermometer and a stirrer was set on a mantle heater. Bisphenol-propylene oxide additive (1,370 parts by weight) and isophthalic acid (443 parts by weight) were placed in the flask to give a ratio of 1.5 in COOH/OH ratio. A dehydration-condensation polymerization was carried out at 250° C. with $N_2$ gas introducing into the flask. Thus a polyester resin of low molecular weight having a weight-average molecular weight (Mw) of 4,300 and a glass transition point (Tg) of 59° C. was obtained.

Separately, a 5-liter four-necked flask equipped with a condenser, a water separator, a $N_2$-gas inlet, a thermometer and a stirrer was set on a mantle heater. Bisphenol-propylene oxide additive (1,720 parts by weight), isophthalic acid (860 parts by weight) and diethylene glycol (129 parts by weight) were placed in the flask to give a ratio of 1.2 in OH/COOH ratio. A dehydration-condensation polymerization was carried out at 240° C. with $N_2$ gas introducing into the flask. Thus a polyester resin of high molecular weight having a weight-average molecular weight (Mw) of 7,000 and a glass transition point (Tg) of 61° C. was obtained.

The obtained low-molecular-weight polyester (60 parts by weight) and the high-molecular-weight polyester (40 parts by weight) were put in Henschel mixer (made by Mitsui Miike Kakoki K.K.) to be blended sufficiently in dry conditions to give a uniform mixture.

The blended materials were put in a heating kneader and added with diphenylmethane-4,4-diisocyanate of 100 parts by weight to give 1.0 in a NCO/OH ratio. The mixture was treated for 1 hour. After confirmation of almost no residual free isocyanate groups, the reactants were cooled to give urethane-modified polyester resin (Tg: 64° C., an acid value: 25).

| ingredients | parts by weight |
|---|---|
| Above obtained urethane-modified polyester resin | 100 |
| Carbon black (pH3, Mogal L, made by Cabot K.K.) | 8 |
| Polypropylene of low molecular weight (TS200, made by Sanyo Kasei K.K.) | 3 |
| Calix arene compound 7 | 2 |

The above ingredients were sufficiently mixed in Henschel mixer (made by Mitsui Miike Kakoki K.K.). The mixture was kneaded in a biaxial kneader. The kneaded material was pulverized coarsely by means of a feather mill and further pulverized finely by a jet mill. The pulverized material was air-classified to give fine particles of a mean particle size of 8 μm.

Hydrophobic silica H-2000 (made by Wacker K.K.) of 0.5 parts by weight was added to the above obtained fine particles of 100 parts by weight. The mixture was treated in Henschel mixer at 1,500 rpm for 1 minute to give Toner 4-1.

EXAMPLE 10

2,2'-bis(p-(2-hydroxy)-phenyl)propane (60 parts by weight), 20 parts by weight of isophthalic acid, 0.1 parts by weight of dibutyltin oxide were placed in a flask and treated under nitrogen atmosphere at 230° C. for 24 hours. The treated materials were taken out of the flask to give polyester resin. The resultant polyester had a weight-average molecular weight of 7,000.

The obtained polyester of 50 parts by weight was dissolved in xylene of 50 parts by weight in a flask. Temperature was risen to reflux xylene. While refluxing xylene, a solution containing 13 parts by weight of styrene, 0.3 parts by weight of diethylaminoethyl methacrylate and 0.4 parts by weight of azobisisobutyronitrile was added dropwise under nitrogen atmosphere for 30 minutes. After dropping, the temperature was kept for 3 hours. Xylene was removed in vacuo to give an amino-modified polyester resin having a weight-average molecular weight (Mw) of 11,000, Mw/Mn=3.0, a melt viscosity of $5\times10^4$ poise at 100° C. and a glass transition point of 61° C.

| ingredients | parts by weight |
|---|---|
| Amino-modified polyester resin | 100 |
| Organic pigment, Lionol Red 6B-4213 | 2.5 |
| Calix arene compound 8 | 2 |

The above ingredients were sufficiently mixed in Henschel mixer (made by Mitsui Miike Kakoki K.K.). The mixture was kneaded in a biaxial kneader. The kneaded material was left to stand for cooling and pulverized coarsely by means of a feather mill and further pulverized finely by a jet mill. The pulverized material was air-classified to give fine particles of a mean particle size of 8 μm.

Hydrophobic silica H-2000 (made by Wacker K.K.) of 0.5 parts by weight was added to the above obtained fine particles of 100 parts by weight. The mixture was treated in Henschel mixer at 1,500 rpm for 1 minute to give Toner 5-1.

EXAMPLE 11

Styrene (150 g), 90 g of butyl methacrylate, 30 g of isobutyl acrylate, 3 g of α-methylstyrene dimer (Nofmer MSD, made by Nippon Yushi K.K.), 2 g of silane coupling agent (TSL8311, made by Toshiba K.K.) and 6 g of 2,2'-azobis(2,4-dimethylvaleronitrile) were mixed and dispersed uniformly by means of a homojetter (made by Tokushu Kika Kogyo K.K.).

Then the obtained uniform dispersion solution was suspended in a solution containing 60 g of a 4% solution of methyl cellulose (Metocell K35LV, made by Dow Chemical K.K.) as a dispersion stabilizer, 5 g of a 1% solution of sodium dioctylsulfosuccinate (Nikkol OTP-75, made by Nikko Chemical K.K.) and 0.3 g of sodium hexametaphosphate dissolved in 650 g of ion-exchanged water.

The suspension was transferred to a four necked flask. The flask was purged with nitrogen. Polymerization was carried out at 50° C. at a stirring speed of 100 rpm for 24 hours. The resultant was filtered and washed repeatedly to give resin particles obtained by suspension polymerization after drying.

| ingredients | parts by weight |
|---|---|
| Suspension-polymerized particles | 100 |
| Carbon Black | 8 |
| Polypropylene of low molecular weight (660P made by Sanyo Kasei Kogyo K.K.) | 4 |
| Calix arene compound 3 | 2 |

The above ingredients were sufficiently mixed in Henschel mixer. The mixture was kneaded in a biaxial kneader. The kneaded material was pulverized coarsely by means of a feather mill and further pulverized finely by a jet mill. The pulverized material was air-classified to give fine particles of a mean particle size of 8 μm.

Hydrophobic silica T-500 (made by Tokyo zairyo K.K.) of 0.5 parts by weight was added to the above obtained fine particles of 100 parts by weight. The mixture was treated in Henschel mixer at 1,500 rpm for 1 minute to give Toner 6-1. The toner had a glass transition point (Tg) of 56° C., a softening point (Tm) of 87° C., a flow-starting point of 78° C. The softening point (Tm) was measured by means of Perfect Oven.

EXAMPLE 12

| ingredients | parts by weight |
|---|---|
| polyester resin | |
| Tafton NE1110 (made by Kao K.K.) | 70 |
| Tafton NE 382 (made by Kao K.K.) | 30 |
| Carbon black (pH:3, Mogul L, Cabot K.K.) | 8 |
| Oxidized type of polypropylene of low molecular weight (TS-200, made Sanyo Kasei Kogyo K.K.) | 3 |
| Calix arene compound 1 | 2 |

Toner 6-2 having a mean particle size of 8 μm was obtained in a manner similar to Example 11 using the above ingredients.

The resultant toner had Tg: 63° C., Tm: 100° C. and a flow-starting point of 82° C.

EXAMPLE 13

Graft carbon black used in this Example was prepared as follows.

| ingredients | parts by weight |
|---|---|
| glycidyl methacrylate | 10 |
| styrene | 60 |
| butyl methacrylate | 30 |
| benzoyl peroxide | 5 |

The above ingredients were placed in a reaction vessel equipped with a stirrer, an inactive gas-inlet, a refluxing condenser and a thermometer together with deionized water containing polyvinyl alcohol at 0.1 wt % to be mixed and dispersed. The dispersion was stirred at a high speed to give a uniform suspension. The suspension was heated to 80° C. while introducing nitrogen gas. Polymerization reaction was carried out for 5 hours with temperature kept at 80° C. Then water was removed to give a polymer having epoxy groups as a reactive group.

The resultant polymer (100 parts by weight), carbon black MA-100R (made by Mitsubishi Kasei Kogyo) of 40 parts by weight were mixed. The mixture was treated for reaction at 160° C. by means of a pressure kneader. The treated materials were cooled and pulverized to give a wax-containing carbon black graft polymer as a coloring agent.

(Core Particles)

Styrene (177 g), 90 g of butyl methacrylate, 30 g of isobutyl acrylate, 3 g of ec-methylstyrene dimer (Nofmer MSD, made by Nippon Yushi K.K.), 2 g of silane coupling agent (TSL8311, made by Toshiba Silicone K.K.), 100 g of graft carbon black, 1 g of lauryl mercaptan and 6 g of 2,2'-azobisisobutyronitrile were mixed and dispersed uniformly by means of a homojetter (made by Tokushu Kika Kogyo K.K.).

Then the obtained uniform dispersion was suspended in a solution containing 60 g of a 4% solution of methyl cellulose (Metocell K35LV, made by Dow Chemical K.K.) as a dispersion stabilizer, 7 g of a 1% solution of sodium dioctylsulfosuccinate (Nikkol OTP-75, made by Nikko Chemical K.K.) and 0.5 g of sodium hexametaphosphate dissolved in 1,000 g of ion-exchanged water by means of a homo-jetter to give a suspension particle size of 3–10 μm.

The suspension was transferred to a four-necked flask. The flask was purged with nitrogen. Polymerization was carried out at 70° C. at a stirring speed of 100 rpm for 24 hours. Thus a core particle-dispersing solution was obtained. The core particles had Tg of 53° C., a softening point of 80° C. and Mw/Mn of 4.0.

(Subcore Particle)

Ammonium persulfate (0.4 g) was dissolved in 800 g of ion-exchanged water. The aqueous solution was put in a four-necked flask. The flask was purged with nitrogen gas and heated to 75° C. A solution containing 30 g of polypropylene (Viscol 660 p, made by Sanyo Kasei Kogyo K.K.) dissolved in a mixed solvent of 200 g of styrene and 4 g of methacrylic acid was added to the flask. Polymerization reaction was carried out at a stirring rate of 500 rpm for 6 hours to give a uniform dispersion containing particles having a particle size of 0.2 μm (Tg: 65° C.).

Separately Calix arene compound 1 and hydrophobic titanium oxide (T-805, made by Nippon Aerosil K.K.) were sufficiently dispersed in ethanol at a weight ratio of 1:1.

On the basis of 100 parts by weight of solid matter of the core particle-dispersing solution, 5 parts by weight of the subcore particles and 0.5 parts by weight of the mixture of Calix arene compound and hydrophobic titanium oxide were dispersed in ion-exchanged water. The dispersion was heated to 70° C. with stirring, so that surfaces of the core particles were treated with the subcore particles, Calix arene compound and hydrophobic titanium oxide.

The treated materials were filtered and washed repeatedly and then dried in a slurry dryer (Dispacoat, made by Nisshin Engineering K.K.). The dried materials were air-classified to give colored particles having a mean particle size of 6 μm.

Hydrophobic silica H-2000 (made by Wacker K.K.) of 0.2 parts by weight was added to the colored particles of 100 parts by weight. The mixture was treated in Henschel mixer (made by Mitsui Miike Kakoki K.K.) at 1,000 rpm for 1 minute to give Toner 7-1.

The resultant toner had Tg: 57° C., a flow-starting point of 73° C. and a softening point of 82° C.

EXAMPLE 14

The colored particles of Example 13 were treated at 7,200 rpm for 3 minutes in Hybridization system (NHS-1 type, made by Nara Kikai Seisakusyo K.K.) prior to post treatment. The resultant was treated with hydrophobic silica under the same conditions as in Toner 7-1 to give Toner 7-2 of a mean particle size of 6 μm.

The resultant toner had Tg: 56° C., a flow-starting point of 73° C. and a softening point of 82° C.

EXAMPLE 15

| ingredients for pressure fixing | parts by weight |
|---|---|
| Polyethylene wax; Hi-Wax 405MP (made by Mitsui Sekiyu Kagaku K.K.) | 30 |
| Paraffin wax; Paraffin Wax 150 (made by Nippon Seiro K.K.) | 70 |
| Carbon black; Mogul L (pH:3, made by Cabot K.K.) | 8 |
| Calix arene compound 2 | 2 |

The above ingredients were molten and kneaded, followed by granulation by spray dryer. The granulated materials were air-classified to give spherical particles of a mean particle size of 8 μm.

Hydrophobic silica R-974 (made by Nippon Aerosil K.K.) of 0.5 parts by weight was added to the above obtained particles of 100 parts by weight. The mixture was treated in Henschel mixer (made by Mitsui Miike Kakoki K.K.) at 1,000 rpm for 1 minute to give Toner 8-1.

EXAMPLE 16

| ingredients for pressure fixing | parts by weight |
|---|---|
| Polyethylene wax; Hi-Wax 200P (made by Mitsui Sekiyu Kagaku K.K.) | 20 |
| Paraffin wax (155, made by Nippon Seiro K.K.) | 80 |
| Carbon black (pH:3, made by Mitsubishi Kasei Kogyo) | 8 |
| Magnetic magnetite (EPT-1,00, made by Toda Kogyo K.K.) | 20 |

The above ingredients were molten and kneaded uniformly at 120° C., followed by granulation by spray dryer to give fine particles of a mean particle size of 8 μm.

Fine polymer particles MP-4951 (MMA/iBMA=1/9, mean particle size of 0.2 μm, glass transition point of 85° C., made by Soken Kagaku K.K.) of 15 parts by weight, Calix arene compound 1 of 1 part by weight and hydrophobic alumina (RX-C, made by Nippon Aerosil K.K.) of 0.5 parts by weight were put in Henschel mixer together with 100 parts by weight of the above fine particles. The mixture was stirred at 1,500 rpm for 2 minutes.

The resultant mixture was treated at 7,200 rpm for 3 minutes by means of Hybridization system (NHS-1 type, made by Nara Kikai Seisakusyo K.K.). The resultant materials were further air-treated to give capsule particles of a mean particle size of 8 μm.

Hydrophobic silica R-974 (made by Nippon Aerosil K.K.) of 0.1 part by weight was added to the above obtained particles of 100 parts by weight. The mixture was treated in Henschel mixer (made by Mitsui Miike Kakoki K.K.) at 1,000 rpm for 1 minute to give Toner 8-2.

EXAMPLE 17

Fine particles having a mean particle size of 6 μm were obtained by controlling pulverizing-classifying conditions of Example 1.

Hydrophobic silica H-2000 (made by Wacker K.K.) of 0.3 parts by weight and fine resin-particles obtained as below of 0.3 parts by weight were added to the above obtained fine particles of 100 parts by weight. The mixture was treated in Henschel mixer (made by Mitsui Miike Kakoki K.K.) at 1,500 rpm for 1 minute to give Toner 9-1.

(Preparation of Fine Resin-Particles)

Ammonium persulfate (0.8 g) was dissolved in 1,500 g of ion-exchanged water. The aqueous solution was put in a four-necked flask. The flask was purged with nitrogen gas and heated to 75° C. Methylmethacrylate (187 g), 15 g of methacrylic acid and 120 g of styrene were added into the flask. Polymerization was carried out at a stirring rate of 500 rpm for 6 hours to give uniform particles having a particle size of 0.2 μm.

EXAMPLE 18

| ingredients | parts by weight |
|---|---|
| glycidyl methacrylate | 10 |
| styrene | 60 |
| butyl methacrylate | 30 |
| benzoyl peroxide | 5 |

The above ingredients were placed in a reaction vessel equipped with a stirrer, an inactive gas-inlet, a refluxing condenser and a thermometer together with deionized water containing polyvinyl alcohol at 0.1 wt % to be mixed and dispersed. The dispersion was stirred at a high speed to give a uniform suspension.

The suspension was heated to 80° C. while introducing nitrogen gas. Polymerization was carried out for 5 hours with temperature kept at 80° C. Then water was removed to give a polymer having epoxy groups as a reactive group.

The resultant polymer (100 parts by weight), carbon black MA-100R (pH: 3, made by Mitsubishi Kasei Kogyo) of 40 parts by weight and polypropylene of low molecular weight (Viscol 605P, made by Sanyo Kasei K.K.) of 5 parts by weight were mixed. The mixture was treated for reaction at 160° C. by means of a pressure kneader. The treated materials were cooled and pulverized to give a wax-containing carbon black graft polymer as a coloring agent.

Deionized water containing sodium dodecylbenzene sulfonate as an anionic surfactant at 0.5 wt %, polymerizable monomer components composed of 80 parts by weight of styrene and n-butyl acrylate of 20 parts by weight, the above obtained carbon black graft polymer of 50 parts by weight, azobisisobutyronitrile of 3 parts by weight and 2,2'-azobis (2,4-dimethylvaleronitrile) of 3 parts by weight were mixed in a same reaction vessel as above mentioned. The mixture was put in T.K.Homomixer (made by Tokusyu Kika Kogyo K.K.) to be mixed and stirred. A uniform suspension was given.

The suspension was heated to 65° C. while introducing a nitrogen gas. Suspension polymerization was carried out at the same temperature for 5 hours. Temperature was risen to 75° C. to finish the polymerization.

Separately hydrophobic silica (H-2000, made by Wacker K.K.) (2 parts by weight), 2 parts by weight of a silane coupling agent (TSL8311, made by Toshiba silicone K.K.) were dispersed in methyl alcohol. This dispersion was admixed with the above obtained suspension. The mixture was heated at 80° C. for 1 hour to give block-like thing with particles fused each other. The block-like thing was filtered and washed repeatedly. The washed thing was left under conditions of 60° C. and 80 RH % for 5 hours in a hot-air dryer and further dried under conditions of 50° C. and 50 RH % for 5 hours.

On the basis of the obtained suspension-polymerized agglomerate of 100 parts by weight, 0.5 parts by weight of Calix arene compound 1, 0.3 parts by weight of hydrophobic silica (H-2000, made by Wacker K.K.) and 0.5 parts by weight of fine particles of titanium oxide (T-1, made by Mitsubishi Material K.K.) were mixed and stirred at 3000 rpm. The mixture was pulverized at 18,000 rpm in Criptron system with an air-inlet temperature set at 0° C. to give pulverized particles having a mean particle size of 6.0 μm. An air-exhaust temperature was 28° C.

Hydrophobic silica H-2000 (made by Wacker K.K.) of 0.2 parts by weight was added to the above obtained particles of 100 parts by weight. The mixture was treated in Henschel mixer (made by Mitsui Miike Kakoki K.K.) at 1,500 rpm for 1 minute to give Toner 11-1.

EXAMPLE 19

| ingredients | parts by weight |
|---|---|
| Styrene | 70 |
| n-butyl methacrylate | 28 |
| Methacrylic acid | 2 |
| 2,2'-azobis (2,4-dimethylvaleronitrile) (first grade, made by Wako Junyaku Kogyo K.K.) | 0.5 |
| Carbon black MA#8 (pH:13) (made by Mitsubishi Kasei Kogyo K.K.) | 10 |
| Polyethylene of low molecular weight (Hi-Wax 110P, made by Mitsui Sekiyu Kagaku kogyo K.K.) | 3 |
| Calix arene compound 1 | 3 |

The above ingredients were sufficiently mixed by means of a sand stirrer to give a polymerizable composition. The polymerizable composition was polymerized in an aqueous solution containing gum arabic at a concentration of 3 wt % by T.K.Autohomomixer (made by Tokusyu Kika Kogyo K.K.) at 60° C. for 6 hours. A temperature was risen to 90° C. to be polymerized.

After polymerization, the reaction system was cooled, washed 5 times, filtered and classified to give spherical particles. The obtained spherical particles were further air-classified to give black particles having a mean particle size of 6 μm.

Hydrophobic silica H-2000 (made by Wacker K.K.) of 0.2 parts by weight was added to the above obtained particles of 100 parts by weight. The mixture was treated in Henschel mixer (made by Mitsui Miike Kakoki K.K.) at 1,500 rpm for 1 minute to give Toner 12-1.

EXAMPLE 20

Polyester resin (NE-382; made by Kao K.K.) (100 g) was dissolved in 400 g of a mixed solvent of methylene chloride/toluene (8/2). The solution was put into a ball mill together with 5 g of phthalocyanine and 5 g of Calix arene compound 2. The mixture was mixed and dispersed uniformly for 3 hours.

Then the obtained uniform dispersion was suspended in a solution containing 60 g of a 4% solution of methyl cellulose (Metocell K35LV, made by Dow Chemical K.K.) as a dispersion stabilizer, 5 g of a 1% solution of sodium dioctylsulfosuccinate (Nikkol OTP-75, made by Nikko Chemical K.K.) and 0.5 g of sodium hexametaphosphate dissolved in 1,000 g of ion-exchanged water by means of T.K.Homomixer (made by Tokusyu Kika Kogyo K.K.) to give a suspension particle size of 3–10 μm in a mean particle size.

This suspension was filtered and washed repeatedly. The obtained particles were dried in a slurry-drying dryer (Dispacoat, made by Nisshin Engineering K.K.) and further air-classified to give colored particles having a mean particle size of 6 μm.

Hydrophobic silica H-2000 (made by Wacker K.K.) of 0.3 parts by weight and 0.5 parts by weight of hydrophobic titanium oxide (T-805, made by Nippon Aerosil K.K.) were added to the above colored particles of 100 parts by weight. The mixture was treated in Henschel mixer (made by Mitsui Miike Kakoki K.K.) at 1,000 rpm for 1 minute to give Toner 13-1.

EXAMPLE 21

Polyester resin (NE-382; made by Kao K.K.) (100 g) was dissolved in 400 g of a mixed solvent of methylene chloride/toluene (8/2).

Then the obtained uniform dispersion was suspended in a solution containing 60 g of a 4% solution of methyl cellulose (Metocell K35LV, made by Dow Chemical K.K.) as a dispersion stabilizer, 5 g of a 1% solution of sodium dioctylsulfosuccinate (Nikkol OTP-75, made by Nikko Chemical K.K.) and 0.5 g of sodium hexametaphosphate dissolved in 1,000 g of ion-exchanged water by means of T.K.Homomixer (made by Tokusyu Kika Kogyo K.K.) to give a suspension particle size of 3–101 μm in a mean particle size.

The obtained suspension was added with 1.0 parts by weight of Calix arene compound 3 sufficiently dispersed in methanol, 1.0 parts by weight of silica (R-972, made by Nippon Aerosil K.K.) on the basis of 100 parts by weight of resin and 3 parts by weight of blue bat dye (Nihonless blue BC, made by Sumitomo Kagaku Kogyo K.K.).

The mixed dispersion was vigorously stirred by the help of ultrasonic vibrator and heated at a rate of 2° C./min to 80° C. These conditions were kept for 1 hour.

This mixed dispersion was cooled, and filtered and washed repeatedly. The obtained particles were dried in a slurry-drying dryer (Dispacoat, made by Nisshin Engineering K.K.) and further air-classified to give colored particles having a mean particle size of 6 μm.

Hydrophobic silica H-2000 (made by Wacker K.K.) of 0.3 parts by weight and 0.5 parts by weight of hydrophobic titanium oxide (T-805, made by Nippon Aerosil K.K.) were added to the above colored particles of 100 parts by weight. The mixture was treated in Henschel mixer (made by Mitsui Miike Kakoki K.K.) at 1,000 rpm for 1 minute to give Toner 13-2.

EXAMPLE 22

(Preparation of Resin-Solution I-A containing Hydrophobic solvent as Medium)

| ingredients | parts by weight |
|---|---|
| Polyester Resin (tafton NE-382, made by Kao K.K.) | 100 |
| Brilliant carmine 6B (C.I. 15850) | 3 |
| Calix arene compound 3 | 1 |

The above ingredients were dispersed uniformly and dissolved in 400 parts by weight of methylene chloride to give Solution I-A (viscosity: 10.2 cp).

(Preparation of Aqueous Solution A)

| ingredients | parts by weight |
|---|---|
| Distilled water | 100 |
| Polyvinyl alcohol (Polymerization degree:500, made by Wako Junyaku Kogyo K.K.) | 2 |
| Sodium laurate | 2 |

The above ingredients were mixed and dissolved uniformly to give solution A (viscosity: 4.1 cp).

Solution A was added gradually to 50 parts by volume of Solution I-A while stirring at 40,000 rpm at 20° C. by means of TK Autohomomixer (made by Tokusyu Kika Kogyo K.K.). When Solution A of 100 parts by volume was added, phase transition was observed. At that time the addition of Solution A was stopped. Stirring was continued for further 10 minutes.

After stirring, the obtained dispersion was poured into distilled water. The obtained suspension was added and mixed with 0.5 parts by weight of hydrophobic silica dispersed in methanol relative to 100 parts by weight of resin, and 0.5 parts by weight of Calix arene compound 1. The silica and Calix arene were adhered to surface of suspension particles. The system was kept at 50° C. and stirred at about 500 rpm to evaporate methylene chloride.

Then filtration and washing were repeated. The obtained particles were dried in a slurry dryer (Dispacoat, made by Nisshin Engineering K.K.). The dried particles were further air-classified to give colored particles having a mean particle size of 6 μm.

Hydrophobic silica (H-2000/4, made by Wacker K.K.) of 0.3 parts by weight and 0.5 parts by weight of hydrophobic titanium oxide (T-805, made by Nippon Aerosil K.K.) were added to the above colored particles of 100 parts by weight. The mixture was treated in Henschel mixer (made by Mitsui Miike Kakoki K.K.) at 1,000 rpm for 1 minute to give Toner 13-3.

EXAMPLE 23

| Ingredients | parts by weight |
|---|---|
| Styrene | 350 g |
| n-butyl methacrylate | 150 g |
| Methacrylic acid | 20 g |
| t-dodecyl mercaptan | 1.0 g |
| Polypropylene (Viscol 605P, made by Sanyo Kasei Kogyo K.K.) | 10 g |

The above ingredients were mixed in a sand stirrer to give a polymerizable composition.

Dodecyl benzenesulfonate (5 g) and 5 g of ammonium persulfate were dissolved in ion-exchanged water (1500 g). The polymerizable composition was added to the aqueous solution. The mixture was stirred and dispersed at 4,000 rpm by TK Autohomomixer.

The obtained uniform dispersion was put in a four-necked flask, which was purged with nitrogen gas. Polymerization was carried out at 70° C. at 150 rpm for 5 hours to give an emulsion polymerization solution having a glass transition point (Tg) of 62° C., a number average molecular weight (Mn) of 15,000, a weight average molecular weight/number average molecular weight ratio (Mw/Mn) of 14.

The obtained emulsion polymerization solution (1,000 ml) (250 g of resin components), 20 g of carbon black (MA#8, made by Mitsubishi Kasei Kogyo K.K.) and 5 g of Calix arene compound 1 were mixed with water at water-content of 50 wt % in a beaker. The obtained slurry was dispersed by TK Autohomomixer at 3,500 rpm for 5 minutes to give a uniformly dispersed mixed solution.

Separately a 1.0 wt % solution of magnesium sulfate was prepared. The solution was kept at 40° C. The above obtained dispersed solution was added dropwise to the magnesium sulfate solution to coagulate particles. A temperature of the system was risen to 80° C. to coagulate particles stronger. The system was cooled to normal temperature. The coagulated materials were filtered and washed with water repeatedly. The washed materials were dried, pulverized and air-classified to give particles having a mean particle size of 81 μm.

Hydrophobic silica (H-2000, made by Wacker K.K.) of 0.2 parts by weight was added to the above obtained particles of 100 parts by weight. The mixture was treated in Henschel mixer (made by Mitsui Miike Kakoki K.K.) at 1,000 rpm for 1 minute to give Toner 13-4.

EXAMPLE 24

Toner 13-5 having a mean particle size of 8 μmm was prepared in a manner similar to Example 23 except that 100 g of magnetic magnetite was further added to the composition of Example 23.

EXAMPLE 25

Ethanol (400 parts by weight) and 50 parts by weight of pure water were placed in a one-liter separable flask equipped with a stirrer, a thermometer and a condenser. Five parts by weight of poly(acrylic acid) (molecular weight of 250,000) was added gradually to the flask while stirring and dissolved completely in the ethanol solution. Then a temperature was risen to 70° C. Separately styrene (70 parts by weight), 25 parts by weight of n-butyl methacrylate, 5 parts by weight of methacrylic acid, 2 parts by weight of azobisisobutyronitrile and 10 parts by weight of graft carbon black prepared in Example 13 were dispersed. This solution was added dropwise to the above ethanol solution for 1 hour. Polymerization was carried out at the same temperature for 12 hours to give particles having a mean particle size of 6 μm.

Separately Calix arene compound 1 and hydrophobic titanium oxide (T-805, made by Nippon Aerosil K.K.) were dispersed in ethanol at a ratio of 1:1. The obtained mixture of Calix arene compound/titanium oxide of 1.5 parts by weight was added to the particle-dispersing system cooled to normal temperature on the basis of 100 parts by weight of particle-solids. Stirring was carried out to treat the mixture of Calix arene compound/titanium on surfaces of the particles.

Then the dispersion was filtered and washed with water. The obtained particles were dried by a slurry dryer (Dispacoat, made by Nisshin Engineering K.K.) and air-classified to give colored particles having a mean particle size of 6 μm.

Hydrophobic silica (H-2000, made by Wacker K.K.) of 0.2 parts by weight was added to the above obtained colored particles of 100 parts by weight. The mixture was treated in Henschel mixer (made by Mitsui Miike Kakoki K.K.) at 1,000 rpm for 1 minute to give Toner 14-1.

EXAMPLE 26

Isophthalic acid (199 parts by weight), 88 parts by weight of adipic acid, 142 parts by weight of 1,6-hexanediol, 81 parts by weight of trimethylolpropane, 150 parts by weight of glycidyl bersatate (Cajuler E10, made by Shell Kagaku K.K.) and 180 parts by weight of xylene were placed in a one-liter separable flask equipped with a stirrer, a thermometer and a condenser. The mixture was heated to 180° C. and then gradually to 220° C. for 3 hours. Reaction was continued at the same temperature. When an acid value of solids was 4 KOH/g, the reaction was stopped.

Separately 620 parts by weight of deionized water and 8 parts by weight of polyvinylalcohol having a polymerization degree of 800 and a saponification value of 98% was put in a one-liter separable flask equipped with a stirrer, a thermometer and a condenser. This solution is referred to as Dispersion Medium 1.

The above obtained polyester (36 parts by weight), 58 parts by weight of styrene, 20 parts by weight of n-butyl acrylate, 0.8 parts by weight of divinyl benzene, 3.4 parts by weight of 2-hydroxyethyl methacrylate, 1.7 parts by weight of methacrylic acid, 5 parts by weight of phthalocyanine, 3 parts by weight of Calix arene compound 1 and 4.0 parts by weight of azobisisobutyronitrile were mixed and dispersed uniformly. This dispersion was added to the Dispersion Medium 1. Polymerization was carried out at 80° C. for 6 hours while stirring.

Then the treated materials were filtered and washed with water. The obtained particles were dried by a slurry dryer (Dispacoat, made by Nisshin Engineering K.K.) and air-classified to give colored particles having a mean particle size of 6 μm.

Hydrophobic silica (H-2000, made by Wacker K.K.) of 0.3 parts by weight and hydrophobic titanium oxide and 0.5 parts by weight of hydrophobic titanium oxide (T-805, made by Nippon Aerosul K.K.) were added to the above obtained colored particles of 100 parts by weight. The mixture was treated in Henschel mixer (made by Mitsui Miike Kakoki K.K.) at 1,000 rpm for 1 minute to give Toner 14-2.

EXAMPLE 27

Styrene (first grade, made by Wako Junyaku Kogyo K.K.) (100 parts by weight), 100 parts by weight of 2-ethylhexyl methacrylate (first grade, made by Wako Junyaku Kogyo K.K.) and 3.0 parts by weight of azobisisobutyronitrile (first grade, made by Wako Junyaku Kogyo K.K.) were dissolved in 300 parts by weight of aliphatic hydrocarbon (Isoper H, made by Shell Kagaku K.K.). This solution was put in a four-necked flask equipped with a condenser and a stirrer. The flask was purged with nitrogen gas by introducing nitrogen gas into the flask for 10 minutes.

Then the system was heated to 75° C. Polymerization was carried out for 6 hours to give a highly viscous liquid containing resin dissolved in Isoper H. The obtained resin (300 g) was dissolved in 100 g of a mixed solvent of dichloromethane/acetone (weight ratio:3/1). Non magnetic ferrite ($CuFe_2O_4$—$CuMn_2O_4$, mean particle size of 0.1–0.2 μm, oil absorption: 35 cc/100 g, made by Dainichi Seika K.K.) of 60 g was added to the above obtained solution to be mixed and dispersed sufficiently by means of a vibration mill.

A solution containing 10 g of isocyanate (Takenate D-102, made by Tkeda Yakuhin K.K.) dissolved in 5 g of ethyl acetate was put in 150 g of the above obtained black ink to give a black ink-isocyanate solution.

A 5 wt % solution of gum arabic (made by Wako Junyaku Kogyo K.K.) was prepared. The solution was collected in a ice-water bath. The black ink-isocyanate solution was added to the 5% solution. Fine particles of Black ink were prepared by means of Autohomomixer (made by Tokusyu Kika Kogyo K.K.) at 7,000 rpm. Stirring was continued for 30 minutes to give a toner-dispersed system.

Then 20 g of a 10 wt % solution of hexamethylenediamine (made by Wako Junyaku Kogyo K.K.) was added dropwise. Reaction was carried out for 10 minutes. Temperature was risen gradually. A temperature of 80°–90° C. was kept to carry out reaction.

Separately Calix arene compound 7 and hydrophobic titanium oxide (T-805, made by Nippon Aerosil K.K.) were ground and dispersed in a water medium at a weight ratio of 1:1 in a sand mill (Paint Conditioner, made by Red Devil K.K.). The obtained mixture of Calix arene compound/titanium oxide of 1.5 parts by weight was added to the toner-dispersed system on the basis of 100 parts by weight of toner-solids. Stirring was further carried out to treat the mixture of Calix arene compound/titanium on surfaces of the toner particles.

Then the toner particles were filtered and washed with water repeatedly. The obtained particles were dried and classified to give black particles having a mean particle size of 8 μmm.

Hydrophobio silica (R972, made by Nippon Aerosil K.K.) of 0.2 parts by weight was added to the black particles of 100 parts by weight. The mixture was treated in Henschel mixer (made by Mitsui Miike Kakoki K.K.) at 1,000 rpm for 1 minute to give non-magnetic capsule Toner 15-1 containing aliphatic hydrocarbon solution.

EXAMPLE 28

| Ingredients | parts by weight |
|---|---|
| Styrene | 60 g |
| n-butyl methacrylate | 35 g |
| Methacrylic acid | 5 g |
| 2,2'-azobis (2,4-dimethylvaleronitrile) | 0.5 g |
| Polypropylene of low molecular weight (Viscol 605P, made by Sanyo Kasei Kogyo K.K.) | 3 g |

The above ingredients were mixed in a sand stirrer to give a polymerizable composition.

The polymerizable composition was polymerized in a 3% aqueous solution of gum arabic while stirring by TK Auto Homo Mixer (made by Tokusyu Kika Kogyo K.K.) at 4,000 rpm at 60° C. for 6 hours to give spherical particles having a mean particle size of 6 μm.

Separately, black dispersion dye (Cayaron Priesterblack S-CONC, made by Nippon Kayaku K.K.) (10 g) was dispersed in 100 ml of pure water. This dispersion was added to the above aqueous suspension containing suspension-polymerized particles. The mixed dispersion was vigorously stirred by the help of ultrasonic vibrator and heated at a rate of 2° C./min to 70° C. These conditions were kept for 1 hour.

Then the obtained suspension was collected, filtered and washed with water repeatedly. The obtained particles were dried by a slurry dryer (Dispacoat, made by Nisshin Engineering K.K.) and air-classified to give colored particles having a mean particle size of 6 μm.

Calix arene compound 6 (1.0 parts by weight) and hydrophobic alumina (RFY-C, made by Nippon Aerosil K.K.) were mixed with the colored particles of 100 parts by weight. Fixing treatment was carried out at a wind velocity of 60 m/sec by means of Hybridization system.

Hydrophobic silica R-974 (made by Nippon Aerosil K.K.) of 0.1 part by weight was added to the above obtained particles of 100 parts by weight. The mixture was treated in Henschel mixer (made by Mitsui Miike Kakoki K.K.) at 1,000 rpm for 1 minute to give Toner 16-1.

EXAMPLE 29

Polyester resin (NE-382; made by Kao K.K.) (100 g) was dissolved in 400 g of a mixed solvent of methylene chloride/toluene (8/2). The solution was put into a ball mill together with 5 g of phthalocyanine. The mixture was mixed and dispersed uniformly for 3 hours.

Then the obtained uniform dispersion was suspended in an aqueous solution containing 60 g of a 4% solution of methyl cellulose (Metocell K35LV, made by Dow Chemical K.K.) as a dispersion stabilizer, 5 g of a 1% solution of sodium dioctylsulfosuccinate (Nikkol OTP-75, made by Nikko Chemical K.K.) and 0.5 g of sodium hexametaphosphate (made by Wako Junyaku K.K.) dissolved in 1,000 g of ion-exchanged water by means of TK Homo Mixer (made by Tokusyu Kika Kogyo K.K.) to give a suspension particle size of 3–10 μm in a mean particle size.

This suspension was filtered and washed repeatedly. The obtained particles were dried in a slurry-drying dryer (Dispacoat, made by Nisshin Engineering K.K.) and further air-classified to give colored particles having a mean particle size of 6 μm.

Calix arene compound 1 (0.3 parts by weight) and hydrophobic silica (H-2000/4, made by Wacker K.K.) of 0.3 parts by weight were mixed with the colored particles of 100 parts by weight at 3,000 rpm for 2 minutes by Henschel mixer. Fixing treatment was carried out at a wind velocity of 60 m/sec by means of Hybridization system (NHS-O type, made by Nara Kikai Seisakusyo K.K.).

Hydrophobic silica (H-2000, made by Wacker K.K.) of 0.3 parts by weight and hydrophobic titanium oxide (T-805, made by Nippon Aerosil K.K.) of 0.5 parts by weight were added to the above obtained colored particles of 100 parts by weight. The mixture was treated in Henschel mixer (made by Mitsui Miike Kakoki K.K.) at 1,500 rpm for 1 minute to give Toner 16-2.

EXAMPLE 30

One hundred parts by weight of mono-dispersion and spherical particles of styrene-n-butyl methacrylate copolymer prepared by seed polymerization (mean particle size of 5 μm, glass transition point of 54° C., softening point of 128° C. and content of gel component (insoluble in toluene) of 15%) and 8 parts by weight of carbon black (pH: 3, MA#8, made by Mitsubishi Kasei Kogyo K.K.) were put in Henschel mixer. The mixture was stirred at 1,500 rpm for 2 minutes to adhere carbon black to surfaces of polymer particles.

Then, fixing treatment was carried out at 6,000 rpm by means of Hybridization system (NHS-1 type, made by Nara Kikai Seisakusyo K.K.) to fix carbon black on surfaces of polymer particles.

The polymer particles treated with carbon black of 100 parts by weight were placed in Henschel mixer together with 20 parts by weight of MMA/iBMA (1/9) particles (mean particle size of 0.2 μm, glass transition point of 85° C., MP-4951, made by soken Kagaku K.K.) and 0.5 parts by weight of Calix arene compound 1. The mixture was mixed and stirred at 1,500 rpm for 2 minutes. The mixture was further treated at 7,200 rpm for 5 minutes by means of Hybridization system (NHS-1 type, made by Nara Kikai Seisakusyo K.K.) to give 3-layer colored particles having a mean particle size of 6 μm.

Hydrophobic silica R-974 (made by Nippon Aerosil K.K.) of 0.2 parts by weight was added to the obtained colored particles of 100 parts by weight. The mixture was treated in Henschel mixer (made by Mitsui Miike Kakoki K.K.) at 1,500 rpm for 1 minute to give Toner 16-1.

EXAMPLE 31

(Preparation of Core Particles)

Styrene (160 g), 90 g of butyl methacrylate, 3 g of isobutyl acrylate, 5 g of polypropylene of low molecular weight (Viscol 605P, Sanyo Kasei Kogyo K.K.), 2 g of lauryl mercaptan, 2 g of silane coupling agent (TSL8311, made by Toshiba Silicone K.K.), 10 g of carbon black (#2300, made by Mitsubishi Kasei Kogyo K.K.), 50 g of magnetic magnetite (EPT-1000, made by Toda Kogyo K.K.) and 6 g of azobisisobutyronitrile were mixed and dispersed uniformly by means of a sand stirrer to give a dispersion.

Then the obtained uniform dispersion was suspended in an aqueous solution containing 60 g of a 4% solution of methyl cellulose (Metocell K35LV, made by Dow Chemical K.K.) as a dispersion stabilizer, 5 g of a 1 wt % solution of sodium dioctylsulfosuccinate (Nikkol OTP-75, made by Nikko Chemical K.K.) and 0.3 g of sodium hexametaphosphate dissolved in 650 g of ion-exchanged water by means of a homo-jetter (made by Tokusyu Kika Kogyo K.K.) to give a suspension particle size of 3–10 μm.

The suspension was transferred to a four-necked flask. The flask was purged with nitrogen. Polymerization was carried out at 60° C. at a stirring speed of 100 rpm for 24 hours. Thus a core particle-dispersing solution was obtained. The core particles had a glass transition point (Tg) of 54° C., a softening point (Tm) of 82° C. and a number average molecular weight (Mn) of 8,000, a weight average molecular weight/number average molecular weight ratio (Mw/Mn) of 24.

(Preparation of Fine Particle)

Ammonium persulfate (0.4 g) was dissolved in 800 ml of ion-exchanged water. The aqueous solution was put in a four-necked flask. The flask was purged with nitrogen gas and heated to 75° C. A mixed solvent of 200 g of methyl methacrylate and 8 g of methacrylic acid was added to the flask. Polymerization was carried out at a stirring rate of 500 rpm for 6 hours to give a uniform dispersion containing fine particles having a particle size of 0.2 μm (Tg: 63° C).

Separately Calix arene compound 1 and hydrophobic titanium oxide (T-805, made by Degussa K.K.) were sufficiently dispersed in water at a weight ratio of 1:1 by means of a sand mill (Paint Conditioner, made by Red Devil K.K.).

(Preparation of Toner)

Eight hundred grams of a 28 wt % slurry of the core particles, 90 g of a 20 wt % slurry of the fine particles and 1 g (referred to as solid content) of mixture of Calix arene compound/hydrophobic titanium oxide were dispersed. The dispersion was transferred to a four-necked flask. Ammonium persulfate (5 g) was added. The flask was purged with nitrogen gas. Reaction was carried out at 70° C. at 160 rpm for 5 hours.

The treated materials were filtered and washed to give colored fine resin-particles the surface of which were coated with fine particles, Calix arene and titanium oxide.

The colored fine resin-particles obtained were air-classified. Hydrophobic silica (R-972, made by Nippon Aerosil K.K.) of 0.1 part by weight was added to the colored resin-particles of 100 parts by weight. The mixture was treated in Henschel mixer (made by Mitsui Miike Kakoki K.K.) at 1,000 rpm for 1 minute to give Toner 17-1 having a mean particle size of 7 μm.

EXAMPLE 32

Core particles having a glass transition point (Tg) of 56° C., a softening point (Tm) of 83° C. and a number average molecular weight (Mn) of 10,000, a weight average molecular weight/number average molecular weight ratio (Mw/Mn) of 26 were obtained in a manner similar to Example 31, except that 10 g of red pigment (Lake red C, made by Dainichi Seika K.K.) was used instead of 10 g of carbon black (#2300, made by Mitsubishi Kasei Kogyo K.K.) and 50 g of magnetic magnetite (EPT-1000, made by Toda Kogyo K.K.).

Red Toner 17-2 having a mean particle size of 7 μm was obtained in a manner similar to Example 31 by the use of the fine particles prepared in Example 31 and Calix arene compound 1.

EXAMPLE 33

The colored fine resin-particles classified in Example 31 were treated at 7,200 rpm for 3 minutes in Hybridization system (NHS-1 type, made by Nara Kikai Seisakusyo K.K.). The fine resin-particles on surfaces were treated for film-formation.

Hydrophobic silica (R-972, made by Nippon Aerosil K.K.) of 0.1 part by weight was added to the colored fine resin-particles of 100 parts by weight. The mixture was treated in Henschel mixer (made by Mitsui Miike Kakoki K.K.) at 1,000 rpm for 1 minute to give Toner 17-3 having a mean particle size of 7 μm.

EXAMPLE 34

(Preparation of Dispersion Assistance)

Pure water (4 Kg), 80 g of tribasic calcium phosphate and 0.12 g of sodium dodecylbenzenesulfonate were put into a 10-liter autoclave.

Benzoyl peroxide (NYPER B, made by Nippon Yushi K.K.) (8 g) was dissolved in a mixed solvent of 640 g of styrene and 160 g of n-butyl methacrylate. This solution was added into the above aqueous solution and stirred.

Polyester resin (NE-382, made by Kao K.K.) (1,200 g) was further added. The autoclave was purged with nitrogen. Temperature of the inside system was risen to 60° C. The temperature was kept for 3 hours to integrate the monomers containing the polymerization-initiator into the polyester resin particles.

Then t-butyl peroxypivalate (Perbable PV, made by Nippon Yushi K.K.) (11.4 g) was added to the above suspension. Temperature of the system was risen to 65° C. and kept for 3 hours to finish polymerization. After cooling, the contents were taken out, washed with an acid solution and water to give modified resin particles as a dispersion assistant.

(Preparation of Dispersion Phase Material)

Pure water (4 Kg), 80 g of tribasic calcium phosphate and 0.12 g of sodium dodecylbenzenesulfonate were put into a 10-liter autoclave.

T-butyl peroxypivalate (Perbable PV, made by Nippon Yushi K.K.) (28.6 g) and benzoyl peroxide (NYPER B, made by Nippon Yushi K.K.) (20 g) were dissolved in a mixed solvent of 1,400 g of styrene, 580 g of n-butyl methacrylate and 20 g of methacrylic acid. This solution was added into the above aqueous solution and stirred.

After the autoclave was purged with nitrogen gas, temperature of the system was risen to 65° C. and kept for 3 hours. Temperature of the system was risen to 75° C. and kept for 3 hours. Then temperature of the system was further risen to 90° C. and kept for 2 hours to finish polymerization. After cooling, the contents were taken out, washed with an acid solution and water and dried to give a copolymer resin.

(Preparation of Domain Phase)

The above copolymer resin (30 parts by weight) and 5 parts by weight of phthalocyanine were molten and kneaded at 140° C. by a biaxial vent kneader. The kneaded materials were pulverized by a feather mill to give colored particles as a domain phase.

(Preparation of Toner)

The above colored particles (35 parts by weight), 65 parts by weight of polyester resin (NE-382, made by Kao K.K.), 3 parts by weight of Calix arene compound 1 and 10 parts by weight of the above modified resin-particles as an dispersion assistant were mixed sufficiently. The mixture was molten and kneaded at 140° C. by a biaxial vent kneader.

The kneaded materials were pulverized coarsely by a feather mill and further pulverized finely by a jet mill. The pulverized particles were air-classified to give blue fine particles having a mean particle size of 8 μm.

Hydrophobic silica (H-2000, made by Wacker K.K.) of 0.3 parts by weight and hydrophobic titanium oxide (T-805, made by Nippon Aerosil K.K.) of 0.5 parts by weight were added to the obtained colored particles of 100 parts by weight. The mixture was treated in Henschel mixer (made by Mitsui Miike Kakoki K.K.) at 1,000 rpm for 1 minute to give Toner 18-1.

EXAMPLE 35

| ingredients | parts by weight |
|---|---|
| Polyester resin (Tafton NE382, made by Kao K.K.) | 100 |
| Brilliant Carmine 6B (C.I. 15850) (pre-pulverized particle:0.1μm) | 3 |
| Calix arene compound 1 | 1 |

The above ingredients were sufficiently mixed in a ball mill. The mixture was kneaded on three rolls heated to 140° C. The kneaded material was left to stand for cooling and pulverized coarsely by means of a feather mill. The obtained particles (100 parts by weight) were dissolved/dispersed in 400 g of a mixed solvent of methylene chloride/toluene (8/2) to give a uniformly mixed and dispersed solution (dispersion phase)(viscosity: 10.1 cp at 20° C).

Then 60 g of a 4% solution of methyl cellulose (Metocell K35LV, made by Dow Chemical K.K.) as a dispersion stabilizer, 5 g of a 1% solution of sodium dioctylsulfosuccinate (Nikkol OTP-75, made by Nikko Chemical K.K.) and 0.5 g of sodium hexametaphosphate were dissolved in 1,000 ml of ion-exchanged water to give an aqueous solution (continuous phase).

The dispersion phase was pressed into the continuous phase through micro-porous glass (pore size: 2.0 μm, thickness: 1.0 mm, $\epsilon=\phi_{10}/\phi_{90}=1.1$, hydrophilic) (made by Ise Kagaku K.K.) to give an emulsion (the pressure was three times a critical pressure).

While the emulsion was being stirred, a temperature of the system was kept at 50° C. to remove the mixed solvent of methylene chloride/toluene. The contents were filtered and washed repeatedly to wash out the dispersion stabilizer adhered to surfaces of particles. The washed particles were dried to give toner particles having a mean particle size of 6.2 μm.

Hydrophobic silica R-974 (mean particle size of 17 μm, made by Nippon Aerosil K.K.) of 0.5 parts by weight was added to the obtained toner particles of 100 parts by weight. The mixture was treated in Henschel mixer (made by Mitsui Miike Kakoki K.K.) at 1,500 rpm for 1 minute to give Toner 19-1.

EXAMPLE 36

| ingredients | parts by weight |
|---|---|
| Styrene | 60 |
| n-butyl methacrylate | 35 |
| Methacrylic acid | 5 |
| 2,2'-azobis (2,4-dimethylvaleronitrile) | 0.5 |
| Polyethylene of low molecular weight (Sun-Wax 1131P, made by Sanyo Kasei Kogyo K.K.) | 3 |
| Carbon black MA#8 (pH:13) | 10 |

The above ingredients were sufficiently mixed by means of a sand stirrer to give a polymerizable composition.

The polymerizable composition was polymerized in an aqueous solution containing gum arabic at a concentration of 3 wt % at 60° C. for 6 hours while stirring at 4,000 rpm by TK Auto Homo Mixer (made by Tokusyu Kika Kogyo K.K.) to give spherical particles having a mean particle size of 6 μm.

Separately Calix arene compound 5 and hydrophobic titanium oxide (T-805, made by Nippon Aerosil K.K.) were sufficiently dispersed in water at a weight ratio of 1:1 by means of a sand mill (Paint Conditioner, made by Red Devil K.K.).

The obtained mixture of Calix arene compound/titanium oxide of 1.5 parts by weight was added to the toner particle-dispersing system on the basis of 100 parts by weight of spherical particle-solids. Stirring was further carried out to treat the mixture of Calix arene compound/titanium on surfaces of the particles.

The treated materials were filtered and washed with water repeatedly to give a cake-like particles. The cake-like particles were dried at 80° C. for 5 hours in a hot air dryer to agglomerate particles each other. In particular, ultra-fine particles of 1 μm or less were molten and fixed on surfaces of particles of 31 μm or more. Thus agglomerates of 50 μm–2 μmm were obtained.

The obtained agglomerates were pulverized and surface-modified at 10,000 rpm in Criptron system (KTM-XL type, made by Kawasaki Jukogyo K.K.) to give particles having a mean particle size of 6.0 μm.

Hydrophobic silica (H-2000, made by Wacker K.K.) of 0.2 parts by weight was added to the obtained particles of 100 parts by weight. The mixture was treated in Henschel mixer (made by Mitsui Miike Kakoki K.K.) at 1,000 rpm for 1 minute to give Toner 20-1.

EXAMPLE 37

| ingredients | parts by weight |
|---|---|
| Styrene-n-butyl methacrylate (softening point:132°C., glass transition point:60°C.) | 100 |
| Carbon black (MA#8, pH3) (made by Mitsubishi Kasei K.K.) | 8 |
| Polypropylene of low molecular weight (Viscol 550P, made by Sanyo Kasei Kogyo K.K.) | 3 |
| Nigrosine dye (Bontron N-01) (made by Sanyo Kasei Kogyo K.K.) | 5 |
| Calix arene compound 6 | 1 |

The above ingredients were sufficiently mixed in a ball mill. The mixture was kneaded on three rolls heated to 140° C. The kneaded material was left to stand for cooling and pulverized coarsely by means of a feather mill and further pulverized finely by a jet mill. The pulverized material was air-classified to give toner particles of a mean particle size of 8 μmm.

Hydrophobic silica R-974 (0.2 parts by weight) was added to the above obtained toner particles of 10 parts by weight. The mixture was treated in Henschel mixer to give Toner 21-1.

EXAMPLE 38

Toner 4-1 prepared in Example 9 was used as a single component developer.

EXAMPLE 39

(Preparation of Core Particle)

One hundred parts by weight of mono-dispersion and spherical particles of styrene-n-butyl methacrylate copolymer prepared by seed polymerization (mean particle size: 8 μmm, coefficient of variation: 5%, shape coefficient SF1: 106, glass transition point of 54° C. and softening point of 128° C.) and 10 parts by weight of a charge transporting material (A-1) having the following formula were put in Henschel mixer of 10-liter capacity. The mixture was stirred at 1,500 rpm for 2 minutes to adhere to the charge transporting material (A-1) to surfaces of polymer particles.

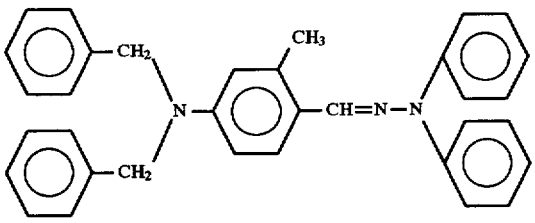

(A-1)

Then, fixing treatment was carried out at 9,000 rpm by means of Hybridization system (NHS-1 type, made by Nara Kikai Seisakusyo K.K.) to fix the charge transporting material on surfaces of polymer particles. Thus core particles were obtained.

(Preparation of Fine Particles)

| ingredients | parts by weight |
|---|---|
| Styrene monomer (made by Wako Junyaku Kogyo K.K.) | 70 |
| n-butyl methacrylate (made by Wako Junyaku Kogyo K.K.) | 30 |
| 2,2'-azobis(2,4-dimethylvaleronitrile) (V-65, made by Wako Junyaku Kogyo K.K.) | 1.5 |
| Charge transporting material (A-1) (represented by the above formula) | 10 |
| Charge transporting material (B-1) (represented by the formula below) | 30 |
| Calixarene compound 5 | 2 |
| Acetone | 100 |

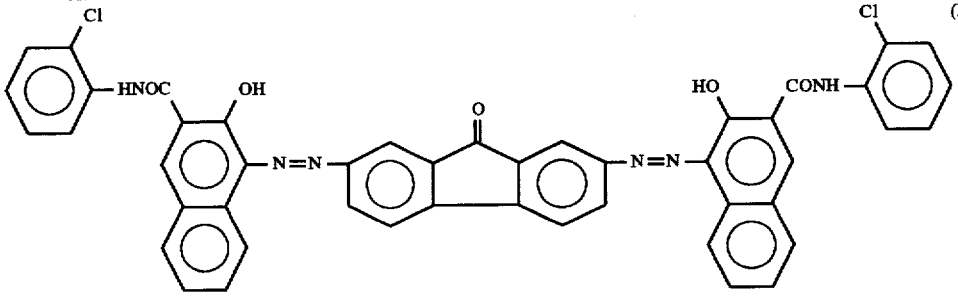

(B-1)

The above ingredients were mixed in a ball mill for 3 hours to give a dispersion. In this case a solution containing a completely saponified polyvinyl alcohol (polymerization degree of about 1,000) at 2% and sodium dodecylbebzene sulfate at 1% in 1,000 ml of distilled water was used as a dispersion medium.

The above obtained dispersion was stirred by means of TK Auto Homo Mixer (made by Tokusyu Kika Kogyo K.K.) as a revolution number of the turbine was increased gradually from 1,500 rpm to 10,000 rpm. Polymerization was carried out at 80° C. for 5 hours while the dispersion was stirred at 10,000 rpm.

After polymerization, polymerized materials were filtered by centrifuge dehydrator and washed 8 times with pure water. The washed materials were dried in vacuo and pulverized to give styrene-acrylic fine particles having a mean particle size of 0.5 μm. The fine particles had a number average molecular weight (Mn) of 8,000, a distribution of molecular weight (Mw/Mn) of 24, a glass transition point of 60° C. and a softening point of 120° C.

The core particles of 100 parts by weight and 10 parts by weight of the fine particles were mixed at 1,500 rpm for 2 minutes in 10-liter Henschel mixer to adhere the fine particles to surfaces of the core particles. Then the obtained particles were treated at 7,200 rpm for 3 minutes in Hybridization system. The fine resin-particles on surfaces were treated for film-formation. Thus photoconductive Toner 22-1 of monodispersion having a mean particle size of 9 μm was obtained.

Preparation of Carrier

Toners prepared in Examples 1 to 39 and Comparative Examples 1 to 3 were mixed with four kind of Carriers A–D as prepared below.

(Carrier A)

Polyester resin (NE-1110, made by Kao K.K.) (100 parts by weight), 600 parts by weight of inorganic magnetic particles (MFP-2, made by TDK K.K.) and 2 parts by weight of carbon black (MA#8, made by Mitsubishi Kasei K.K.) were mind and pulverized sufficiently in Henschel mixer.

The pulverized materials were melted and kneaded in an extruder with a cylinder portion set at 180° C. and a cylinder head portion at 170° C.

The kneaded materials were cooled, pulverized coarsely. The pulverized materials were further pulverized finely by a jet mill and classified by an air-classifier to give a binder-type Carrier A having a mean particle size of 55 μm.

(Carrier B)

Ferrite carrier cores (F-300, made by Powdertech) were coated with a thermosetting silicone resin by means of a rolling fluid bed (SPIRA COTA, made by Okada Seiko K.K.) to give Carrier B having a mean particle size of 50 μm.

(Carrier C)

Ferrite carrier cores (F-300, made by Powdertech) were coated with polyethylene by a surface-polymerization-coating method to give Carrier C having a mean particle size of 51 μm.

(Carrier D)

The same ferrite cores as used in preparation of Carrier B were coated with thermosetting silicone resin modified by acrylic component by a dipping method to give Carrier D having a mean particle size of 50 μm.

EVALUATION (Measurement of Particle Size)

A particle size of tone or carrier was measured as follows.

(1) Toner Particle Size

A mean particle size of toner particles was obtained by measuring a relative weight distribution of particle size with aperture tube of 100 μm by the use of Coulter counter II type (made by Coulter Counter K.K.).

(2) Carrier Particle Size

A carrier particle size was obtained by means of SAL 1100 (made by Shimazu Seisakusho K.K.) to give a mean particle size.

Measurement of Charge Amount and Amount of Lowly Chargeable Toner

Figure 4:
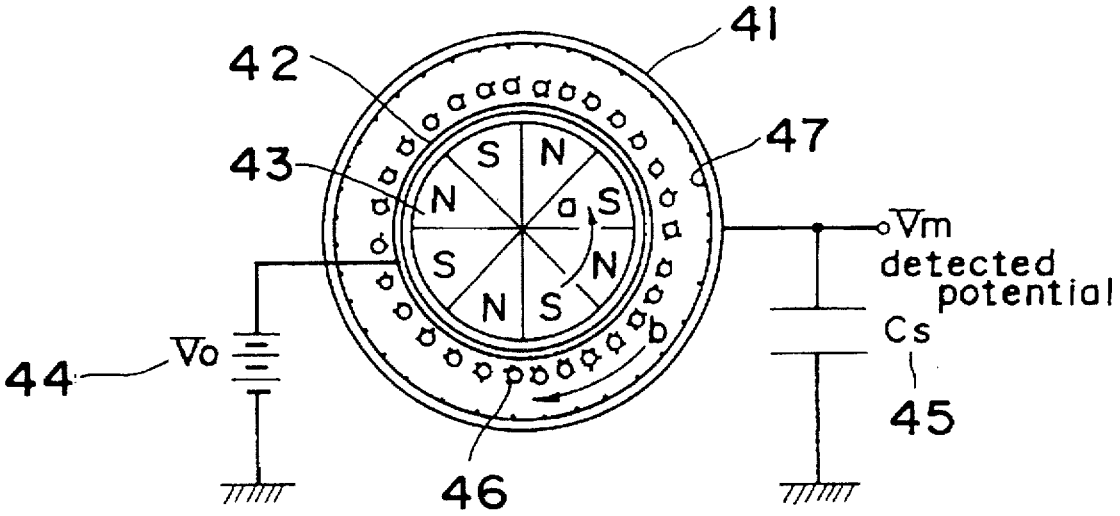
FIG. 4 shows a schematic arrangement of a measuring machine for a charge amount and an amount of lowly chargeable toner.

A charge Amount and an amount of lowly chargeable toner were measured by a machine shown in FIG. 4.

1) Measurement of Charge Amount

A revolution number of a magnet roll (43) was set to 1,000 rpm. A developer was stirred on a roll for 30 minutes. About one gram of the developer was weighed precisely by a precision balance. The weighed developer was put uniformly on the surface of an electrically conductive sleeve (42) all over.

A bias voltage (3 kV) with the same polarity as that of toner chargeability was applied to the sleeve through a bias electric power supply (44). The magnet roll was revolved for 30 seconds. A value of condenser voltage (Vm) was read when the magnet roll was stopped. At the same time, a weight of toner amount adhered to a cylindrical electrode (41) (Mi) was measured by a precision balance to give a mean charge amount of toner. A developer containing toner at a toner-mixing ratio of 5 wt % was prepared. The developer was left for 24 hours under conditions of 23° C. and relative humidity of 55%. The developer was put on a revolution roll to be mixed and stirred for 30 minutes.

2) Measurement of Amount of Lowly Chargeable Toner

An amount of lowly chargeable toner was measured in a manner similar to the measurement of charge amount of toner, except that a bias voltage was not applied to the electrically conductive sleeve (42). Then An amount of toner transferred from the sleeve to the cylindrical electrode (41) was measured to be calculated as a ratio to the all amount of toner placed on the sleeve. The ratio was ranked as follows;

x: more than 2 wt %

Δ: 1–2 wt %

○: less than 1 wt %

Environmental Stability of Charge Amount (Q/M)

With respect to the developers, the following charge amounts were measured:

a charge amount ($Q_{L/L}$) after the developer was left for 24 hours under conditions (L/L) of relative humidity of 15% and temperature of 5° C., a charge amount ($Q_{H/H}$) after the developer was left for 24 hours under conditions (H/H) of relative humidity of 85% and temperature of 35° C., a charge amount ($Q_{N/N}$) after the developer was left for 24 hours under conditions (N/N) of relative humidity of 55% and temperature of 23° C.

According to the following formulas, values A and B were calculated and ranked as follows;

$$A = \left| \frac{Q_{L/L} - Q_{N/N}}{Q_{N/N}} \right| \times 100$$

$$B = \left| \frac{Q_{N/N} - Q_{H/H}}{Q_{N/N}} \right| \times 100$$

○: both *A* and *B* are less than 15%,
Δ: on of *A* and *B* is 15% or more,
x: both *A* and *B* are more than 15%.

Evaluation of Copy Images

Toner and carrier above obtained were mixed at a toner/carrier ratio of 5/95 as shown in Table 5 and Table 6 to give a two-component developer. The obtained developer was evaluated by copying machines shown in the tables.

(1) Fogs with respect to Copy Images

Each of the developers was used to form copy images by the use of the copying machine. Toner-fogs on the white ground were observed to be ranked. When the rank is higher than "Δ", the toner can be put into practical use. The preferable rank is "○".

(2) Durability with respect to Copy

Each of the developers was subjected to durability test with respect to 10,000 times of copy of the chart with a B/W ratio of 6%. The symbol "○" in the tables means that there is no problem with respect to practical use and the symbol "x" means there are some problems with respect to practical use.

(3) Light Transmittance

Toners obtained in Examples 5, 8, 10, 20, 21, 22, 26, 29, 34 and 35 were subjected to a light-transmittance test. The light-transmittance was observed visually on color-clearness when copy images fixed on OHP sheet were projected by an OHP projector. The results were shown in Table 4 and Table 5. The symbol "○" in Tables means that the toner can be put into practical use with respect to color-reproducibility.

The results above obtained were summarized in Table 5 and Table 6.

TABLE 5

| Ex./C. Ex. *1 | Toner | Carrier | Charge amount [μC/g] | Toner amount of low chargeability | Enviromental stability | Image evaluation (fogs) initial | after 50K | light-transmittance | Machine |
|---|---|---|---|---|---|---|---|---|---|
| Ex. 1 | 1-1 | A | −18 | ○ | ○ | ○ | — | — | EP-570Z |
| Ex. 2 | 1-2 | B | −16 | ○ | ○ | ○ | — | — | EP-350 *4 |
| Ex. 3 | 1-3 | A | −20 | ○ | ○ | ○ | ○ | — | EP-570Z |
| Ex. 4 | 1-4 | A | −19 | ○ | ○ | ○ | — | | EP-570Z |
| Ex. 5 | 1-5 | A | −21 | ○ | ○ | ○ | 10K ○ | ○ | CF-70 *5 |
| Ex. 6 | 2-1 | A | −19 | ○ | ○ | ○ | ○ | — | EP-570Z |
| Ex. 7 | 2-2 | A | −21 | ○ | ○ | ○ | ○ | — | EP-570Z |
| Ex. 8 | 3-1 | D | −24 | ○ | ○ | ○ | — | ○ | CF-70 *6 |
| Ex. 9 | 4-1 | C | −20 | ○ | ○ | ○ | ○ | — | SP-500 |
| Ex. 10 | 5-1 | B | −21 | ○ | ○ | ○ | — | ○ | CF-70 *7 |
| Ex. 11 | 6-1 | *2 | — | — | ○ | ○ | — | — | SP-101 *8 |
| Ex. 12 | 6-2 | A | −23 | ○ | ○ | ○ | | | EP-570Z *9 |
| Ex. 13 | 7-1 | *2 | — | — | ○ | ○ | — | — | SP-101 *10 |
| Ex. 14 | 7-2 | *2 | — | — | ○ | ○ | 10K ○ | — | SP-101 *11 |
| Ex. 15 | 8-1 | A | −16 | ○ | ○ | ○ | — | — | EP-570Z *12 |
| Ex. 16 | 8-2 | *3 | — | — | ○ | ○ | — | — | PC-30 *13 |
| Ex. 17 | 9-1 | A | −19 | ○ | ○ | ○ | — | — | EP-570Z |
| Ex. 18 | 11-1 | D | −27 | ○ | ○ | ○ | ○ | — | SP-500 |
| Ex. 19 | 12-1 | D | −28 | ○ | ○ | ○ | — | — | SP-500 |
| Ex. 20 | 13-1 | D | −29 | ○ | ○ | ○ | — | ○ | CF-70 *14 |

*1: Ex.: Example, C. Ex.: Comparative Example
*2: nonmagentic one-component
*3: magnetic one-component
*4: magnetic toner and magnetic carrier
*5, *6 and *7: fixing machine of oil-coated type
*8, *9, *10 and *11: fixing temperature of 130° C.
*12: fixing machine remodelled to pressure-fixing type
*13: jumping developing system, pressure-fixation
*14: fixing machine of oil-coated type

TABLE 6

| Ex./C. Ex. *1 | Toner | Carrier | Charge amount [μC/g] | Toner amount of low chargeability | Enviromental stability | Image evaluation (fogs) initial | after 10K | light-transmittance | Machine |
|---|---|---|---|---|---|---|---|---|---|
| Ex. 21 | 13-2 | B | −25 | ○ | ○ | ○ | — | ○ | CF-70 *3 |
| Ex. 22 | 13-3 | A | −23 | ○ | ○ | ○ | — | ○ | CF-70 *4 |
| Ex. 23 | 13-4 | B | −24 | ○ | ○ | ○ | — | — | EP-570Z |
| Ex. 24 | 13-5 | B | −18 | ○ | ○ | ○ | — | — | *5 |
| Ex. 25 | 14-1 | B | −24 | ○ | ○ | ○ | — | — | EP-570Z |
| Ex. 26 | 14-2 | A | −23 | ○ | ○ | ○ | — | ○ | CF-70 *6 |
| Ex. 27 | 15-1 | B | −24 | ○ | ○ | ○ | — | — | EP-50 *7 |
| Ex. 28 | 16-1 | A | −27 | ○ | ○ | ○ | — | — | EP-570Z |
| Ex. 29 | 16-2 | D | −29 | ○ | ○ | ○ | — | ○ | CF-70 *8 |
| Ex. 30 | 16-3 | A | −34 | ○ | ○ | ○ | — | — | EP-570Z |
| Ex. 31 | 17-1 | A | −23 | ○ | ○ | ○ | — | — | EP-350Z |
| Ex. 32 | 17-2 | B | −16 | ○ | ○ | ○ | — | — | EP-570Z |
| Ex. 33 | 17-3 | A | −25 | ○ | ○ | ○ | — | — | EP-570Z |
| Ex. 34 | 18-1 | B | −17 | ○ | ○ | ○ | — | ○ | CF-70 *9 |
| Ex. 35 | 19-1 | D | −26 | ○ | ○ | ○ | — | ○ | CF-70 *10 |
| Ex. 36 | 20-1 | D | −28 | ○ | ○ | ○ | — | — | SP-500 |
| Ex. 37 | 21-1 | A | +26 | ○ | ○ | ○ | ○ | — | EP-410 |
| C. Ex. 1 | 1-A | A | −10 | x | — | x | — | — | EP-570Z |
| C. Ex. 2 | 1-B | A | −12 | x | — | x | — | — | EP-570Z |

TABLE 6-continued

| Ex./C. Ex. *1 | Toner | Carrier | Charge amount [μC/g] | Toner amount of low chargeability | Enviromental stability | Image evaluation (fogs) initial | after 10K | light-transmittance | Machine |
|---|---|---|---|---|---|---|---|---|---|
| C. Ex. 3 | 1-C | A | −16 | Δ | x | Δ | x | — | EP-570Z |
| Ex. 38 | | *2 | — | — | ○ | ○ | 5K ○ | — | SP-101 |

*1: Ex.: Example, C. Ex.: Comparative Example
*2: non-magnetic one component
*3 and *4: fixing machine of oil-coated type
*5: use of developing apparatus of FIG. 5
*6: fixing machine of oil-coated type
*7: fixing machine remodelled to pressure-fixing type, polarity change of transferring charge and photosensitive member
*8, *9 and *10: fixing machine of oil-coated type The coping machines EP-570Z and EP-350, digital full color copying machine CF-70, printer SP-500, printer SP-101, copying machines EP-50, EP-350Z and EP-410 are made by Minolta Camera K.K. The copying machine PC-30 is made by Canon K.K.

Figure 5:
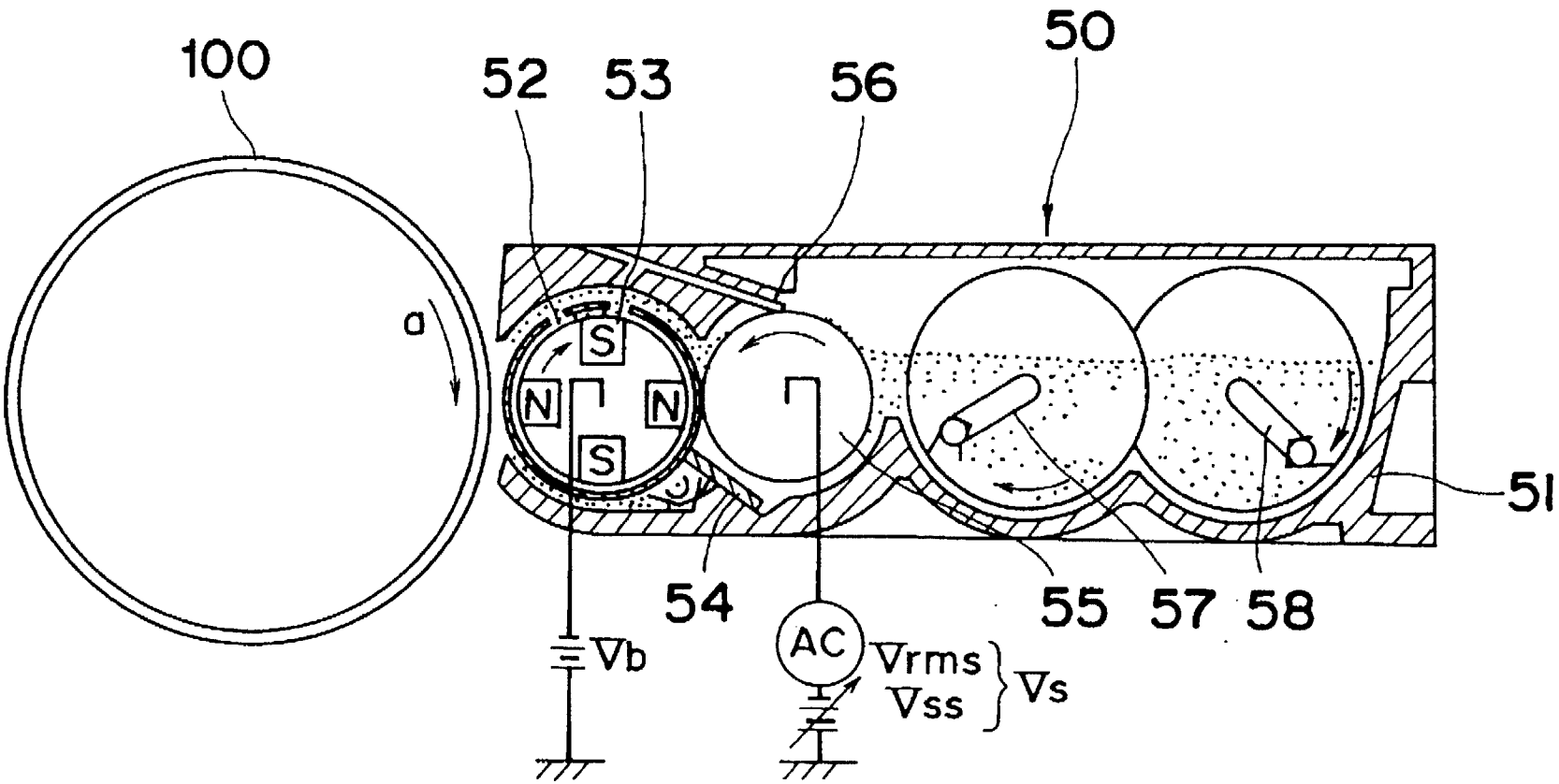
FIG. 5 shows another schematic arrangement of a developing apparatus.

The developing machine of FIG. 5 referred to in Table 6 was installed in a copying machine EP350 (made by Minolta Camera K.K.). The developing machine shown in FIG. 5 is explained hereinafter.

FIG. 5 shows an example of a two-component developing machine. The two-component developing machine (50) is composed of a photosensitive drum (100) driven to rotate in the direction of an arrow (a) and a casing (51). An developing sleeve (52) is installed opposite to the photosensitive drum (100) in the front portion of the casing (51). The developing sleeve (52) is cylindrical and made of non-magnetic and electrically conductive materials. A developing bias voltage is applied to the sleeve. The sleeve can be rotated in the direction of an arrow by a driving source (not shown).

A magnetic roller (53) is set inside the developing sleeve (52). Plural magnets of N-polarity and S-polarity are arranged alternately with the magnets set in the direction of axial length of the roller.

An ear-height levelling member (54) is furnished diagonally backward to the developing sleeve (52). The levelling member is arranged oppositely to the developing sleeve (52) so that a specified gap may be formed between the outer periphery of the developing sleeve (52) and the top of the levelling member. A toner-remaining portion is formed in the upper reaches of the rotating direction of the developing sleeve.

A toner-supplying roller (toner supporter) is arranged backward to the developing sleeve (52) so that a specified supplying gap may be formed between the developing sleeve and the roller.

The toner-supplying roller (55) is made of nonmagnetic and electrically conductive materials. Fine concavities are formed on the outer peripheral portion of the roller by an etching method or a blasting method. The roller (55) can be rotated in the direction of an arrow by a driving source (not shown).

A negative side of direct current source (Vss) is applied to the toner-supplying roller (55) through an alternating current source (Vrms) as a recovering bias (Vs). In particular, the direct current source (Vss) is variable.

An edge portion of toner-levelling blade (toner-levelling member) attached to the casing (51) is pressed against an upper outer peripheral portion of the toner-supplying roller (55).

Toner hoppers are formed in a rear portion of the casing divided with the toner-supplying roller (55) and the levelling blade. Transferring vanes (57) and (58) are arranged rotatably.

In the developing machine constituted as above mentioned, a toner is charged in the hoppers, a starting developer containing toner and carrier at a specified ratio is charged in the developing sleeve (52) and the toner-remaining portion.

Figure 6:
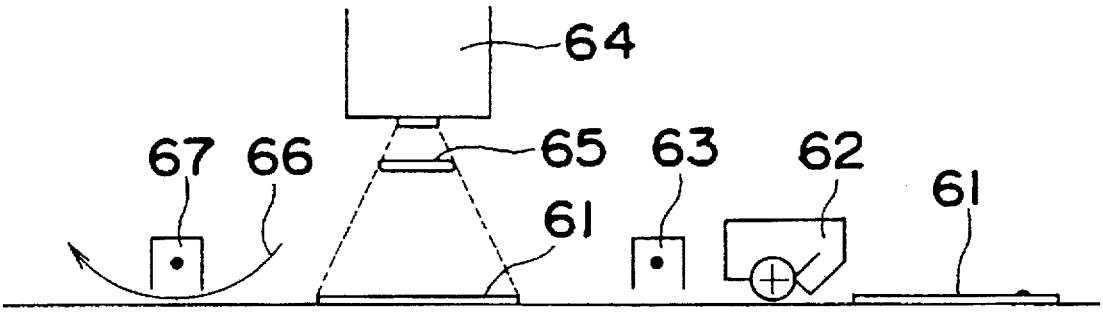
FIG. 6 shows a schematic arrangement of an evaluation system of a developer.

Photoconductive Toner 22-1 prepared in Example 39 (20 g) were mixed with 380 g of Carrier A to give a two-component developer. The developer was evaluated by an evaluation system of copy images shown in FIG. 6 in which a developing machine for a copying machine EP-360 (made by Minolta Camera K.K.) was used as a developing machine (62). A thin layer of photoconductive toner was formed on an electrically conductive substrate (61) by the developing machine. The thin layer is electrically charged at a power of −5 KV by a corona charger (63) in the dark. Successively the thin layer is irradiated by a halogen lamp (64) through a manuscript slide (65) to form electrostatic latent images. Then copy paper (66) was stuck firmly on the substrate. The paper was electrically charged at a power od +5 KV by a corona charger (67) to transfer the photoconductive toner on the electrostatic latent images to copy paper(66). The transferred toner was heated and fixed to give clear and violet-blue positive images

Application of Calix Arene Compound as Charge-Giving Material (Production Example A of Coating Layer on Blade)

A dispersion containing Calix arene compound 1 of 3 parts by weight dispersed uniformly in 100 parts by weight of solids of a silicone hard coating solution (Tosguard 510, made by Toshiba Silicone K.K.) was applied uniformly to the phosphor bronze blade shown in FIG. 1 by a spraying method. The coating was dried with air for 30 minutes and thermoset at 150° C. for 1 hour. Thus Blade A coated with a silicone resin layer having a thickness of 5 μm was obtained.

(Production Example B of Coating Layer on Blade)

A dispersion containing Calix arene compound 2 of 5 parts by weight dispersed uniformly in 10 parts by weight of solids of a thermocrosslinking acrylic coating solution (Paraloid AT-50, made by Rhom & Haas K.K.) was applied uniformly to the phosphor bronze blade shown in FIG. 2 by a spraying method. The coating was dried with air for 30 minutes and thermoset at 120° C. for 1 hour. Thus Blade B coated with an acrylic coating layer having a thickness of 5 μm was obtained.

(Production Example C of Coating Layer on Blade)

Blade C coated with a polyester coating-layer having a thickness of 8 μm was obtained in a manner similar to Production Example A of Coating Layer on Blade, except that a coating solution containing polyester resin (Vylon 200, made by Toyobo K.K.) in toluene was used.

(Production Example D of Coating Layer on Blade)

Blade D coated with a silicone resin layer having a thickness of 5 μm was obtained in a manner similar to Production Example A of Coating Layer on Blade, except that Spilon black TRH (made by Hododani Kagaku Kogyo K.K.) of 3 parts by weight was added instead of Calix arene compound 1.

(Production Example A of Coating Layer on Sleeve)

A dispersion containing Calix arene compound 3 of 3 parts by weight dispersed uniformly in a silicone hard coating solution was applied uniformly to the aluminum sleeve shown in FIG. 2 by a dipping method. The coating was dried with air for 30 minutes and thermoset at 150° C. for 1 hour. Thus Sleeve A coated with a silicone resin layer having a thickness of 5 μm was obtained.

(Production Example B of Coating Layer on Sleeve)

A dispersion containing Calix arene compound 5 of 3 parts by weight dispersed uniformly in a silicone hard coating solution was applied uniformly by a spraying method to the 40 μm endless belt sleeve (shown in FIG. 2) made of Nickel obtained by a Nickel electroforming method. The coating was dried with air for 30 minutes and thermoset at 150° C. for 1 hour. Thus Sleeve B coated with a silicone resin layer having a thickness of 6 μm was obtained.

(Production Example C of Coating Layer on Sleeve)

Sleeve C coated with a silicone resin layer having a thickness of 6 μm was obtained in a manner similar to Production Example A of Coating Layer on Sleeve, except that Spilon black TRH (made by Hododani Kagaku Kogyo K.K.) of 3 parts by weight was added instead of Calix arene compound 3.

EXAMPLE 40

A developing machine of FIG. 1 attached with Blade A was installed in a copying machine EP-50 (made by Minolta Camera K.K.) to give a copying machine of single-component developing system.

Toner A prepared as below was used in the copying machine to evaluate copy images at an initial stage and durability with respect to copy and the like. The results are shown in Table 7.

(Preparation of Toner A)

| ingredients | parts by weight |
|---|---|
| Styrene-n-butyl methacrylate | 100 |
| Carbon black (Laben 1250) (made by Colombia Carbon K.K.) | 8 |
| Polypropylene of low molecular weight (Viscol 605P, made by Sanyo Kasei Kogyo K.K.) | 2 |

The above ingredients were sufficiently mixed in a ball mill. The mixture was kneaded on three rolls heated to 140° C. The kneaded material was left to stand for cooling and pulverized coarsely by means of a feather mill and further pulverized finely by a jet mill. The pulverized material was air-classified to give fine particles of a mean particle size of 8 μmm.

Hydrophobic silica R-974 (made by Nippon Aerosil K.K.) of 0.2 parts by weight was added to the above obtained fine particles of 100 parts by weight. The mixture was treated in Henschel mixer at 1,000 rpm for 1 minute to give Toner A.

(Measurement of Particle Size)

A particle size of toner or carrier prepared later was measured as follows.

A mean particle size of toner was obtained by measuring relative weight distribution of particle size with aperture tube of 100 μm by the use of Coulter Counter TAll type (made by Coulter Counter K.K.).

A particle size of carrier was measured by Micro Track Model 7995-10SRA (made by Nikkiso K.K.) to give a mean particle size.

(Evaluation)

1) Fogs in Copy Images

Toner-fogs in copy images on a white ground were evaluated. Excellent copy images were formed and few fogs were observed. This fact means that toner was electrically charged sufficiently.

2) Fogs on Ground after Copy of Black Solid Images

A manuscript half of which was black was used. This manuscript was copied to evaluate toner fogs on white ground. There were few fogs in spite of black-solid images. This fact means that toner can be electrically charged speedily and that excellent copy images can be formed stably independent of manuscripts.

3) Durability with respect to Copy

After evaluation of copy images at an initial stage, 10,000 times of copy was carried out. Copy images were evaluated visually. As shown in Table 7, excellent copy images were formed stably with few fogs at any stage of copy. This fact means that the coating layer containing a charge controlling agent shown in the present invention and formed on a blade has sufficient durability. In addition, there was no problem with respect to toner-fusing on the blade.

EXAMPLES 41–44 AND COMPARATIVE EXAMPLES 4–6

A copying machine, blade and sleeve shown in Table 7 were installed. The number of developing machine quoted in Table 7 means the Figure number. Evaluation was carried out in a manner similar to Example 40. In Comparative Example 6, Sleeve D made of aluminum used in Production Example A of Coating Layer on Sleeve was used which had not a resin-coating layer. The results are shown in Table 7.

TABLE 7

| Ex./C. Ex. *1 | Constitution of developing machine | Constitution of blade | Sample of sleeve | Fogs on white ground | Fogs in black solid images | Durability test with respect to copy 1,000 sheets | 5,000 sheets |
|---|---|---|---|---|---|---|---|
| Ex. 40 | 1 | A | — | no | no | very good | very good |
| Ex. 41 | 2 | B | — | no | no | very good | very good |
| Ex. 42 | 1 | C | — | no | no | very good | very good |
| C. Ex. 4 | 1 | D | — | many | many | good | x |
| Ex. 43 | 1 | — | A | no | no | very good | very good |
| Ex. 44 | 2 | — | B | no | no | very good | very good |
| C. Ex. 5 | 1 | — | C | many | many | good | x |
| C. Ex. 6 | 1 | — | D | very many | very many | x | — |

*1: Ex.: Example, C. Ex.: Comparative Example (Production Example of Carrier E)

| ingredients | parts by weight |
|---|---|
| Polyester resin (softening point:123°C., glass transition point:65, AV:23, OHV:40) | 100 |
| Inorganic magnetic particles (MFP-2, made by TDK K.K.) | 500 |
| Carbon black (MA#8, made by Mitsubishi Kasei K.K.) | 2 |

The above ingredients were mixed sufficiently and pulverized in Henschel mixer.

The pulverized materials were melted and kneaded in an extruder with a cylinder portion set at 180° C. and a cylinder head portion at 170° C.

The kneaded materials were cooled, pulverized coarsely. The pulverized materials were further pulverized finely by a jet mill and classified by an air-classifier to give a magnetic Carrier E having a mean particle size of 55 μm.

(Production Example of Carrier F)

Magnetic Carrier F having a mean particle size of 55 μm was prepared in a manner similar to Production Example of Carrier E, except that Calix arene compound 5 of 3 parts by weight was further added in addition to the ingredients of Production Example of Carrier E.

(Production Example of Carrier G)

Silicone resin (SR-2400, made by Tray silicone K.K.) (150 g) was dissolved in 21 g of toluene to give a coating solution. Then core particles Ferrite F-300 (mean particle size: 50 μm, electrical resistance: $3.50\times10^7$ Ωcm, made by Powdertech K.K.) of 3,000 parts by weight were treated with the coating solution for 120 minutes by Spira Cota SP-40 (made by Okada Seiko K.K.) under conditions of a spray pressure of 3.5 Kg/cm$^2$, a spray amount of 40 g/min and a temperature of 50° C. The obtained particles were filtered through sieve (opening of the sleeve: 105 μm) to remove aggregates. Thus coated carrier (a) was obtained.

The above carrier (a) of 400 parts by weight and Calix arene compound 6 of 2 parts by weight were treated at 1,000 rpm for 40 minutes in Angmill AM-20F (made by Hosokawamikulon K.K.). The treated carrier particles were filtered through sieve (opening of the sleeve: 150 μm) to remove aggregates. Thus Carrier G having a mean particle size of 52 μm was obtained.

(Production Example of Carrier H)

| ingredients | parts by weight |
|---|---|
| Styrene-Acrylic copolymer resin (SBM-73F, made by Sanyo Kasei K.K.) | 100 |
| Magnetic particles (EPT-1000, made by Toda Kogyo K.K.) (mean particle size: 0.3–0.5 μm) | 200 |
| Calix arene compound 8 | 5 |

The above ingredients were sufficiently mixed in Henschel mixer. The mixture was kneaded in a biaxial kneader. The kneaded material was left to stand for cooling and pulverized coarsely by means of a jet mill. The pulverized material was air-classified to give fine polymer particles of a mean particle size of 3 μm containing the magnetic particles and charge controlling agent.

The above polymer particles of 5 parts by weight and Ferrite Carrier F-300 (mean particle size of 50 μm of 1,000 parts by weight were treated at 1,000 rpm for 40 minutes in Angmill AM-20F (made by Hosokawamikulon K.K.) to give Carrier H having a mean particle size of 55 μm.

EXAMPLES 45 TO 47 AND COMPARATIVE EXAMPLE 7

A specified carrier shown in Table 8 and Toner A were mixed at a toner/carrier ratio of 5/95 to give two-component developers. These developers were evaluated on copy images, durability with respect to copy and the like as shown in Table 7. In Examples 45 to 47 and Comparative Example 7, a copying machine EP-4321 (made by Minolta Camera K.K.) was used. The results were shown in Table 7.

1) Charge Amount (Q/M) and Scattering Amount

Toner A (1.5 g) and the 28.5 g of each Carrier (E to H) were put in a 50 cc poly bottle and stirred at 1,200 rpm for 10 minutes to evaluate electrification-build-up properties, charge amount of toner and toner-scattering amount. A charge amount of toner and a toner-scattering amount were also measured after a poly bottle containing toner and carrier was preserved under conditions of 35° C. and 85% in relative humidity in order to evaluate humidity resistance.

The scattering amount was measured by the use of a digital dust measuring apparatus of P5H2 type (made by Shibata Kagaku K.K.). The dust measuring apparatus was spaced 10 cm apart from a magnet roll, and 2 g of the developer was placed on the magnet roll, which was rotated at 2,000 rpm. Then the dust measuring apparatus detected toner particles scattering as dust and displayed a resultant value in the number of counts per minute, i.e. cpm.

A scattering amount of 300 cpm or less is ranked as the symbol "○". A scattering amount of 500 cpm or less is ranked as the symbol "Δ". A scattering amount of more than 500 cpm is ranked as the symbol "x". When the rank is higher than "Δ", the toner can be put into practical use. Preferable rank is "○".

2) Fogs with respect to Copy

Each of developers was used in the above mentioned copying machine to form copy images. With respect to fogs, toner-fogs formed on white ground were evaluated to be ranked. When the rank is higher than "Δ", the toner can be put into practical use. Preferable rank is "○".

3) Durability with respect to Copy

Each of the developers was subjected to durability test with respect to 10,000 times of copy of the chart with a B/W ratio of 6% by the use of EP-410 to evaluate copy images and fogs. The symbol "○" in Table 8 means that there is no problem with respect to practical use and the symbol "x" means there are some problems with respect to practical use.

4) Humidity Resistance Test

After EP-470 copying machine was left for 24 hours under high humid conditions of 35° C. and 85% in relative humidity, copy images were evaluated and a charge amount and scattering amount were measured.

The above obtained results were summarized in Table 8.

TABLE 8

| | | Initial stage | | | Humidity resistance | | | Durability with respect to copy (images/fogs) | | |
|---|---|---|---|---|---|---|---|---|---|---|
| Ex./C. Ex. *1 | Carrier No. | Q/M (μC/g) | Scattering | Fogs in images | Q/M (μC/g) | Scattering | Fogs in images | 1,000 sheets | 5,000 sheets | 10,000 sheets |
| Ex. 45 | F | +19 | ○ | ○ | +18 | ○ | ○ | ○ | ○ | ○ |
| Ex. 46 | G | +17 | ○ | ○ | +16 | ○ | ○ | ○ | ○ | ○ |
| Ex. 47 | H | +16 | ○ | ○ | +16 | ○ | ○ | ○ | ○ | ○ |
| C. Ex. 7 | E | +9 | Δ | Δ | +6 | x | x | Δ | x | — |

*1: Ex.: Example, C. Ex.: Comparative Example

What is claimed is:

1. A toner for developing an electrostatic latent image formed on an electrostatic latent image supporting member, comprising a calix arene compound expressed by the following general formula [I], a colorant, and a resin material:

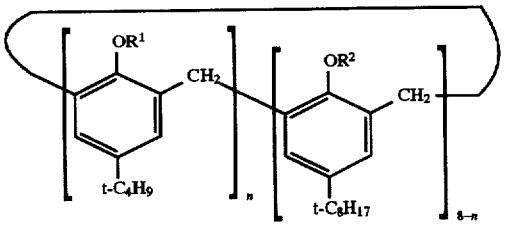

[I]

wherein $R_1$ and $R_2$ each represent a hydrogen atom, an alkyl group having a carbon number of 1 to 5, or $—(CH_2)mCOOR_3$ (in which $R_3$represents a hydrogen atom or a lower alkyl group; and m represents an integer of 1 to 3); n represents an integer of 1 to 7.

2. The toner according to claim 1, wherein the toner has a mean particle size of from 2 to 20 μm.

3. The toner according to claim 1, wherein the calix arene compound is dispersed in the resin material.

4. The toner according to claim 3, wherein a content of the calix arene compound is 0.1 to 20 parts by weight relative to 100 parts by weight of the resin material, and wherein the compound has a particle size of not more than 5 μm.

5. The toner according to claim 1, in which the calix arene compound is adhered to surface of the toner.

6. The toner according to claim 5, wherein a content of the calix arene compound is 0.001 to 10 parts by weight relative to 100 parts by weight of the resin material, and wherein the compound has a particle size of not more than 1 μm.

7. The toner according to claim 1, wherein the resin material is a homopolymer or copolymer resin which is synthesized from styrene monomers, (metha)acrylic monomers and/or (metha)acrylate monomers, or a polyester resin.

8. The toner according to claim 7, wherein the resin has a number-average molecular weight (Mn) of $1000 \leqq Mn \leqq 7000$, and a ratio of weight-average molecular weight (Mw) to number-average molecular weight (Mw/Mn) of $40 \leqq Mw/Mn \leqq 70$.

9. The toner according to claim 1, wherein the resin material has a glass transition temperature of 55° to 70° C. and a softening point of 80° to 150° C. and contains 5 to 20 wt % of gel components.

10. The toner according to claim 1, further comprising an offset inhibitor.

11. The toner according to claim 10, wherein the offset inhibitor is a polyolefin wax having a number-average molecular weight (Mn) of 1,000 to 20,000 and a softening point (Tm) of 80° to 150° C.

12. The toner according to claim 1, comprising colored resin-particles including the calix arene compound, the colorant and the resin material and, in admixture therewith, a cleaning auxiliary comprising a metallic soap and/or a fine resin-particles selected from the group consisting of fluorine, styrene, styrene-(metha)acrylic, benzoguanamine, melamine, and epoxy resins.

13. The toner according to claim 1, further comprising inorganic fine particles selected from the group consisting of silica, aluminum oxide, titanium oxide, and magnesium fluoride.

14. The toner according to claim 1, further comprising a magnetic fine particles.

15. The toner according to claim 1, which is produced by subjecting the constituents including at least the calix arene compound, the colorant, and the resin material to the steps of heating and melting, cooling, grinding, and classifying.

16. The toner according to claim 15, in which the toner is a spherical toner which is subjected to a heat treatment.

17. The toner according to claim 1, which is a suspension polymerized toner produced by dispersing in water more than one kind of monomer and a polymerization initiator substantially insoluble in water but soluble in the monomer to cause a reaction for polymerization.

18. The toner according to claim 1, which is an encapsulated toner comprising a core composed of the resin material and the colorant coated, and an outer layer covering the core.

19. The toner according to claim 1, which is a suspension granulated toner produced by dispersing in a dispersion medium a resin solution composed of an organic solvent and a binder resin dissolved therein.

20. The toner according to claim 1, which is a non-aqueous dispersion polymerized toner produced by dispersing more than one kind of monomer and a polymerization initiator substantially insoluble in water but soluble in the monomer in a dispersion medium comprised of an organic solvent or a water/organic solvent mixture to cause a reaction for polymerization.

21. The toner according to claim 1, produced by a spray dry process.

22. The toner according to claim 1, produced by aggregating colored resin-particles obtained by wet granulation, then pulverizing the aggregates.

23. The toner according to claim 1, wherein the colorant is a carbon black having a pH of less than 7.

24. The toner according to claim 1, wherein the colorant is a carbon black graft polymer.

25. The toner according to claim 24, wherein the carbon black graft copolymer comprises:

a) a carbon black having a functional group on the surface thereof; and b) a polymer having a reactive group capable of ready reaction with the functional group present on the carbon black surface.

26. The toner according to claim 25, wherein said functional group present on the carbon black surface is a hydroxyl group, a carboxyl group or a carbonyl group, and said reactive group of the polymer is at least one group selected from the group consisting of aziridine, oxazoline, N-hydroxyalkylamide, epoxy, thioepoxy, isocyanate, vinyl, amino, and silicone-based hydrolyzable groups.

27. The toner according to claim 26, wherein the polymer has a number-average molecular weight of 500–1,000,000.

28. The toner according to claim 1, further comprising a second calix arene compound of the general formula [I] having an n value of 0 to 8, wherein said first and second calix arene compounds have different values of n.

29. A toner for developing an electrostatic latent image, comprising a calix arene compound expressed by the following general formula [I], a polyester resin, and a colorant:

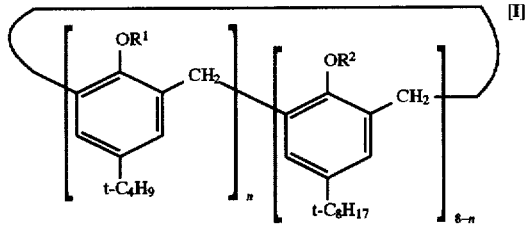

wherein $R_1$ and $R_2$ each represent a hydrogen atom, an alkyl group having a carbon number of 1 to 5, or $—(CH_2)mCOOR_3$ (in which $R_3$ represents a hydrogen atom or a lower alkyl group; and m represents an integer of 1 to 3); n represents an integer of 1 to 7.

30. The toner according to claim 29, wherein the polyester resin is a resin comprised principally of a linear urethane-modified polyester (C) obtained by treating a linear polyester resin (A) with di-isocyanate (B).

31. The toner according to claim 29, wherein the polyester resin has a number-average molecular weight (Mn) of $1{,}000 \leqq Mn \leqq 7{,}000$, and a ratio of weight-average molecular weight (Mw) to number-average molecular weight (Mn) of $40 \leqq Mw/Mn \leqq 70$.

32. The toner according to claim 29, wherein the polyester resin is a linear polyester resin having a glass transition temperature of 55° to 70° C. and a softening point of 80 to 150° C.

33. The toner according to claim 29, wherein the polyester resin is a linear polyester resin having a glass transition temperature of 55° to 80° C. and a softening point of 80° to 150° C. which contains 5 to 20 wt % of gel components.

34. The toner according to claim 29, wherein the polyester resin is a vinyl-modified polyester resin obtained by graft-polymerizing or block-polymerizing an unsaturated polyester component comprised of an aliphatic unsaturated dibasic acid and a polyvalent alcohol with a vinyl monomer component which includes a vinyl monomer and an amino group-containing vinyl monomer.

35. The toner according to claim 29, wherein the colorant is included at an amount of 1 to 10 parts by weight relative to 100 parts by weight of the resin for the toner.

* * * * *